US007934452B2

(12) United States Patent
Faist

(10) Patent No.: US 7,934,452 B2
(45) Date of Patent: May 3, 2011

(54) DEVICES COMPRISING SEVERAL SPACED-APART STORAGE COMPARTMENTS

(75) Inventor: Bernd Klaus Faist, Ochsenfurt (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 40 days.

(21) Appl. No.: 12/448,360

(22) PCT Filed: Dec. 6, 2007

(86) PCT No.: PCT/EP2007/063398

§ 371 (c)(1),
(2), (4) Date: Jun. 18, 2009

(87) PCT Pub. No.: WO2008/077730

PCT Pub. Date: Jul. 3, 2008

(65) Prior Publication Data

US 2010/0018424 A1 Jan. 28, 2010

(30) Foreign Application Priority Data

Dec. 22, 2006 (DE) ..... 10 2006 061 316

(51) Int. Cl.
*B41F 27/12* (2006.01)

(52) U.S. Cl. ..... 101/477; 101/480

(58) Field of Classification Search ..... 101/477, 101/480

See application file for complete search history.

(56) References Cited

U.S. PATENT DOCUMENTS 3,793,950 A * 2/1974 Kaneko et al. ..... 101/142
5,526,747 A * 6/1996 Marmin et al. ..... 101/477
5,537,926 A * 7/1996 Beisel et al. ..... 101/477
5,701,822 A * 12/1997 Metrope ..... 101/477
5,782,182 A * 7/1998 Ruckmann et al. ..... 101/180
6,125,757 A * 10/2000 Lemelin ..... 101/477
6,742,455 B2 * 6/2004 Fukui ..... 101/477
(Continued)

FOREIGN PATENT DOCUMENTS

WO WO 2004/085157 A1 10/2004

*Primary Examiner* — Jill E Culler
(74) *Attorney, Agent, or Firm* — Jones, Tullar & Cooper, P.C.

(57) ABSTRACT

At least several spaced apart storage compartments are provided in a plate storage device. These compartments can receive used printing forms from a printing cylinder or new printing forms that are to be supplied to the printing cylinder. At least one positioning assembly is utilized to adjust at least one mouth region of two of the storage compartments to the same spaced position, with respect to the printing cylinder, at different times in the operating cycle of the plate storage compartments. This mouth region is situated facing the printing cylinder. In another embodiment, at least one printing form, that is being received from the printing cylinder, can be stored in at least one storage compartment. At least one conveying apparatus is provided and includes an entraining mechanism for gripping the printing form that is to be removed. Alternatively, the conveying apparatus can be used with a new printing form that is to be fed to the printing cylinder and which is stored in at least one of the storage compartments. At least one advancing mechanism is provided and is comprised of a slider that can grip the printing form that is to be fed. A positioning assembly lifts and lowers the storage compartment, relative to the entraining mechanism and/or the slider or lifts and lowers the entraining mechanism and/or the slider relative to the storage compartment.

61 Claims, 22 Drawing Sheets

U.S. PATENT DOCUMENTS

| | | | | |
|---|---|---|---|---|
| 7,156,022 | B2 | 1/2007 | Schneider et al. | |
| 2002/0005129 | A1* | 1/2002 | Nagano et al. | 101/477 |
| 2003/0037688 | A1* | 2/2003 | Fukui | 101/477 |
| 2004/0221758 | A1* | 11/2004 | Klein et al. | 101/477 |
| 2005/0172846 | A1* | 8/2005 | Schneider et al. | 101/477 |
| 2006/0005726 | A1* | 1/2006 | Zink | 101/477 |

* cited by examiner

DEVICES COMPRISING SEVERAL SPACED-APART STORAGE COMPARTMENTS

CROSS-REFERENCE TO RELATED APPLICATIONS

This application is the U.S. national phase, under 35 U.S.C. 371, of PCT/EP2007/063398, filed Dec. 6, 2007; published as WO 2007/077730 A2 and A3 on Jul. 3, 2008 and claiming priority to DE 10 2006 061 316.3 filed Dec. 22, 2006, the disclosures of which are specifically incorporated herein by reference.

FIELD OF THE INVENTION

The present invention is directed to devices comprising a plurality of storage compartments which are arranged spaced from one another. The storage compartments are spaced from each other and are adapted to store either a printing forme that has been removed from a forme cylinder or a printing forme which is to be loaded onto the forme cylinder. At least one positioning device is associated with the plurality of storage compartments.

BACKGROUND OF THE INVENTION

A device which is usable for storing a blanket to be supplied to a cylinder of a printing press, and a method for supplying blankets to a cylinder of a printing press are known from WO 2004/085157 A1. At least two storage planes, which are arranged spaced from one another, are provided. A printing forme, which is to be mounted on a forme cylinder of a rotary printing press, can be stored on each storage plane. At least one conveyor mechanism, for use in conveying the respective printing forme up to or away from the forme cylinder, is provided. The storage planes are spaced substantially perpendicular to the direction of conveyance of the printing formes to be supplied to or carried away from the forme cylinder. With the device of WO 2004/085157 A1, printing formes to be supplied to a forme cylinder of a rotary printing press are conveyed by virtue of gravitational force from a first storage plane to a second storage plane. Such a conveyance is accomplished once a retaining assembly, which hold the printing forme in its first storage plane, have been released from the relevant printing forme. In the severe conditions which often exist in a rotary printing press, this release process can cause problems.

SUMMARY OF THE INVENTION

The object of the present invention is to provide devices having a plurality of storage compartments that are arranged spaced from one another. The reliability in supplying a printing forme to be supplied to the forme cylinder or in removing a printing forme to be removed from the forme cylinder is improved through the use of the storage device in accordance with the present invention.

The object in accordance with the present invention is attained with the provision of a storage device that is provided with a plurality of storage compartments which are arranged spaced at a distance from each other. These storage compartments are usable to receive a printing forme that has been removed from a forme cylinder, or to store a printing forme that will be loaded on a forme cylinder. A positioning device is usable with the storage device to selectively locate an opening area of a selected one of the at least two storage compartments facing the forme cylinder. Each opening area of its associate storage chamber can be placed against the forme cylinder at the appropriate time. At least one conveyor device, which is provided with a printing forme engaging carrier is provided in the used printing forme receiving compartment. An advancing mechanism, with a slider element, is in the new printing forme delivery compartment. A positioning assembly is usable to adjust the positions of the carrier and slider relative to its compartment.

The benefits to be achieved in accordance with the present invention consist, in particular, that a printing forme can be reliably supplied to, or can be reliably removed from a forme cylinder of a rotary printing press using the described devices.

BRIEF DESCRIPTION OF THE DRAWINGS

A preferred embodiment of the present invention is represented in the accompanying set of drawings and will be described in greater detail in what follows. The drawings show.

DESCRIPTION OF THE PREFERRED EMBODIMENTS

Figure 1:
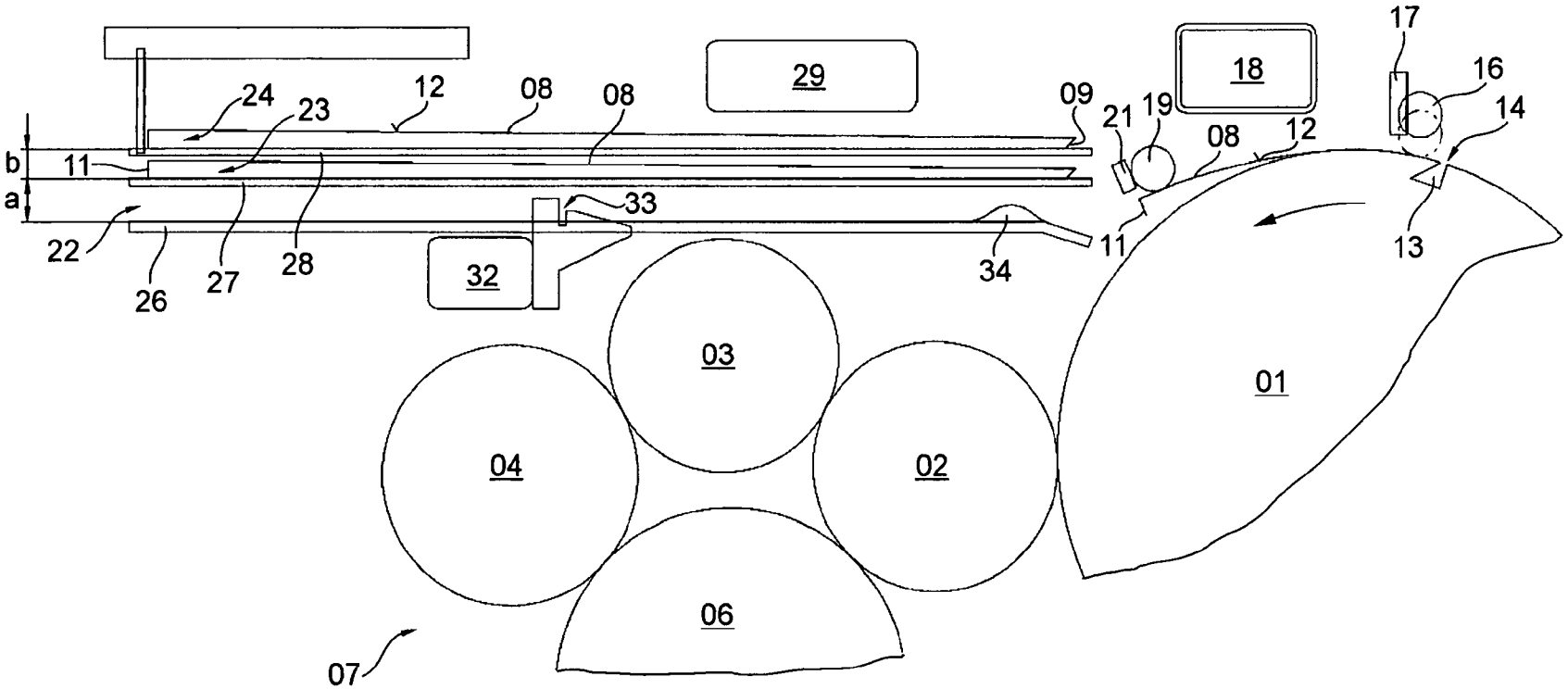
FIG. 1 to 10 various individual steps of a plate loading process.

FIGS. 1 to 10 each schematically show the same section of a printing couple of a rotary printing press, and together illustrate the sequence of steps which occur during plate removal, and specifically which occur during the removal of printing formes from a forme cylinder of this printing couple. FIGS. 11 to 15 each show the same section of the printing couple of the rotary printing press shown in FIGS. 1 to 10, and illustrate the sequence of steps which occur during plate loading, and specifically which occur during the supplying of printing formes to the forme cylinder of this printing couple. The printing formes to be supplied and/or removed are preferably flexible in structure in a direction along their length, which is a direction that is generally perpendicular to the axis of rotation of the forme cylinder. Each of the printing formes is typically embodied as being generally plate-shaped and provided with a substantially rectangular surface. This substantially rectangular surface typically measures between 400 mm and 1300 mm in length, for example, and measures between 280 mm and 1500 mm in width, for example. Preferred measurements for printing formes used in newspaper printing, for example, range from 360 mm to 800 mm in length, for example, and from 250 mm to 430 mm in width, for example.

In each of FIGS. 1 to 15, at least parts of a forme cylinder 01, an ink forme roller 02 and other rollers 03, 04, 06 of an inking unit 07 are represented. In the configuration which is shown in FIGS. 1 to 15, two printing formes 08 can be arranged, one in front of another, on the circumference of the forme cylinder 01. Each printing forme 08 has a preferably acutely angled suspension leg 09 at its leading end and a suspension leg 11 which is angled substantially at a right angle or an obtuse angle, for example, at its trailing end, with the respective suspension legs 09; 11 each measuring a few millimeters, such as, for example, measuring between 3 mm and 15 mm, in length. A material thickness of the suspension legs 09; 11, which may be made, for example, of a metallic material, ranges from 0.15 mm to 0.5 mm and is, for example, 0.3 mm. The respective angling of the suspension legs 09; 11 is directed toward the rear or under side of the respective printing forme 08. In other words, the angling is directed toward the printing forme surface which faces away from its print image side 12, and which is located between its leading and trailing ends. The respective printing forme 08, when each is mounted on the circumferential surface of the forme cylinder 01, rests with that underside surface on the circumferential surface of the forme cylinder 01. The forme cylinder 01 has at least one axially parallel and extending groove 13 on its periphery, in the opening 14 of which groove 13 at least one of the suspension legs 09; 11 of the respective printing forme 08 is suspended. The opening 14 of the respective groove 13 is preferably slit-shaped in configuration and has a slit width of less than 5 mm, for example, and preferably has a slit width ranging from 1 mm to 3 mm. In FIGS. 1 to 15, only one of the two grooves 13, which are typically arranged offset 180° from one another on the circumference of the forme cylinder 01, is shown. Additionally, this groove 13 is represented only schematically relative to the printing forme 08 which is to be removed, and is not shown true to position. In the selected section of a printing couple of the rotary printing press shown in FIGS. 1 to 15, the intention is merely to indicate the general presence of these printing forme end receiving grooves 13. The circumferential position of the respective groove 13 that is necessary for the plate removal and/or loading sequence is adjusted by a rotational movement of the forme cylinder 01 in the appropriate direction.

Near the periphery of the forme cylinder 01, there is provided at least one contact pressure element 16, which may be, for example, a roller element 16, and preferably may be a roller strip 16. Actuation of a positioning assembly 17 causes the contact pressure element 16 to execute a radial movement relative to the forme cylinder 01, thereby allowing it to be engaged against, or to be disengaged from the circumferential surface of the forme cylinder 01. When the contact pressure element 16 is engaged in this manner, a printing forme 08 will be pressed against the circumferential surface of the forme cylinder 01, for example. This is indicated in FIGS. 1 to 15 by the use of dashed lines representing the contact pressure element 16. In FIGS. 1 to 15, a device 18 for use in supplying a printing forme 08 true to register for loading is also indicated. This register device 18, when it is actuated, positions at least one stop, which is not specifically shown, in an infeed plane for the printing forme 08 to be loaded. The printing forme 08 to be loaded strikes laterally against the at least one stop during its infeed movement. The printing forme 08 to be loaded is thus guided laterally. Preferably, a guide element 19, such as for example, a roller guide element 19, which is actuable via a positioning assembly 21, is also provided near the periphery of the forme cylinder 01. When this guide element 19 is actuated, it serves to guide preferably the trailing end of a printing forme 08 that is to be removed from the forme cylinder 01.

At least one first storage compartment 22, in which at least one printing forme 08 that has been removed can be stored, is provided. This first storage compartment 22 is preferably oriented in a preferably substantially tangential alignment relative to the circumference of the forme cylinder 01. In the preferred embodiment of the present invention, which is represented in the drawings, a plurality of removed printing formes 08, such as, for example two such printing formes, can preferably be stored one above the other in this first storage compartment 22. A first printing forme 08 to be removed is placed on a first support surface 26 that belongs to this first storage compartment 22. At a preferably invariable distance "a" from this first support surface 26 of the first storage compartment 22, with this distance "a" remaining constant over its respective length, for example, at least one second storage compartment 23 is provided. A printing forme 08, that is to be loaded on the forme cylinder 01, can be stored in this second storage compartment 23. The second storage compartment 23 preferably has a second support surface 27, on which second support surface the printing forme 08, that is to be loaded onto the forme cylinder 01, is placed. The printing forme 08 to be loaded rests, on at least a portion of its length or surface, on this second support surface 27 until it is loaded onto the forme cylinder 01.

A third storage compartment 24, in which another printing forme 08, that is to be loaded onto the forme cylinder 01, can be stored, is preferably provided at another, such as, for example, a constant, distance "b" from the second support surface 27 belonging to the second storage compartment 23. This additional printing forme 08 to be loaded is preferably placed or, at least can be placed on a third support surface 28 belonging to this third storage compartment 24. The respective distance "a"; "b" between the respective support surfaces 26; 27; 28 of the relevant storage compartments 22; 23; 24, preferably remains constant over the length of the relevant storage compartment 22; 23; 24. Each such distance "a"; "b" exists preferably perpendicular to a direction of conveyance of the printing formes 08 to be conveyed toward or away from the forme cylinder 01. The respective direction of conveyance of each printing forme 08 is oriented substantially parallel to a longitudinal extension of the respective support surface 26; 27; 28, which respective support surface 26; 27; 28 runs parallel to the length of the respective printing forme 08. The respective storage compartments 22; 23; 24 are all arranged with their respective support surfaces 26; 27; 28 substantially parallel to one another, for example. The respective support surface 26; 27; 28 can each be embodied as at least one holding member for holding the respective printing forme 08 to be stored, or as at least one guide rail which engages laterally on the respective printing forme 08 to be stored, for example. Each respective printing forme 08 to be stored preferably rests, or at least can be placed, with only its two edges that each respectively extend parallel to the length of the respective printing forme 08, rather than over its entire surface, on suitable, spaced guide rails, which are arranged opposite one another in pairs, as may be seen by referring to FIG. 16 and FIG. 17.

Each of these storage compartments 22; 23; 24, which are all used to each store at least one printing forme 08, accordingly has a boundary that separates it from its respective surrounding area. Each of the storage compartments 22; 23; 24 preferably has a support surface 26; 27; 28 on which at least one printing forme 08, which is to be stored in the respective storage compartment 22; 23; 24, can be placed. In each case, the respective boundary of the relevant storage compartment 22; 23; 24 is provided, for example, by the relevant support surface 26; 27; 28 for the respective printing forme 08 to be stored there. The dimensions of each relevant storage compartment 22; 23; 24 are also each defined by the relevant support surface 26; 27; 28. The dimensions of each respective storage compartment 22; 23; 24, in terms of its length and width, are preferably defined such that each relevant storage compartment 22; 23; 24 encompasses the flat, rectangular surface of a plate-shaped printing forme 08 to be stored therein. The height of each respective storage compartment 22; 23; 24 is preferably defined such that a printing forme 08, to be stored in this storage compartment 22; 23; 24, and including its respective angled suspension legs 09; 11, can be fully placed therein, without projecting into another one of the adjacent storage compartments 22; 23; 24, which are arranged, for example, in a stack, one above the other. The relevant storage compartments 22; 23; 24 are slightly longer and slightly wider, such as preferably by only a few millimeters, and for example preferably longer and wider by between 1 mm and 10 mm, than are the respective printing forme or formes 08 which are to be stored in this relevant storage compartment 22; 23; 24. The same criteria applies to the height of each respective storage compartment 22; 23; 24. The storage compartments 22; 23; 24, with their respective support surfaces 26; 27; 28, can preferably be provided in a magazine for use in storing printing formes 08, for example. That magazine preferably has a housing which encompasses the respective storage compartments 22; 23; 24 together, for example. These storage compartments 22; 23; 24, with their respective associated support surfaces 26; 27; 28, if applicable, each form a component part of the relevant overall magazine.

Figure 16:
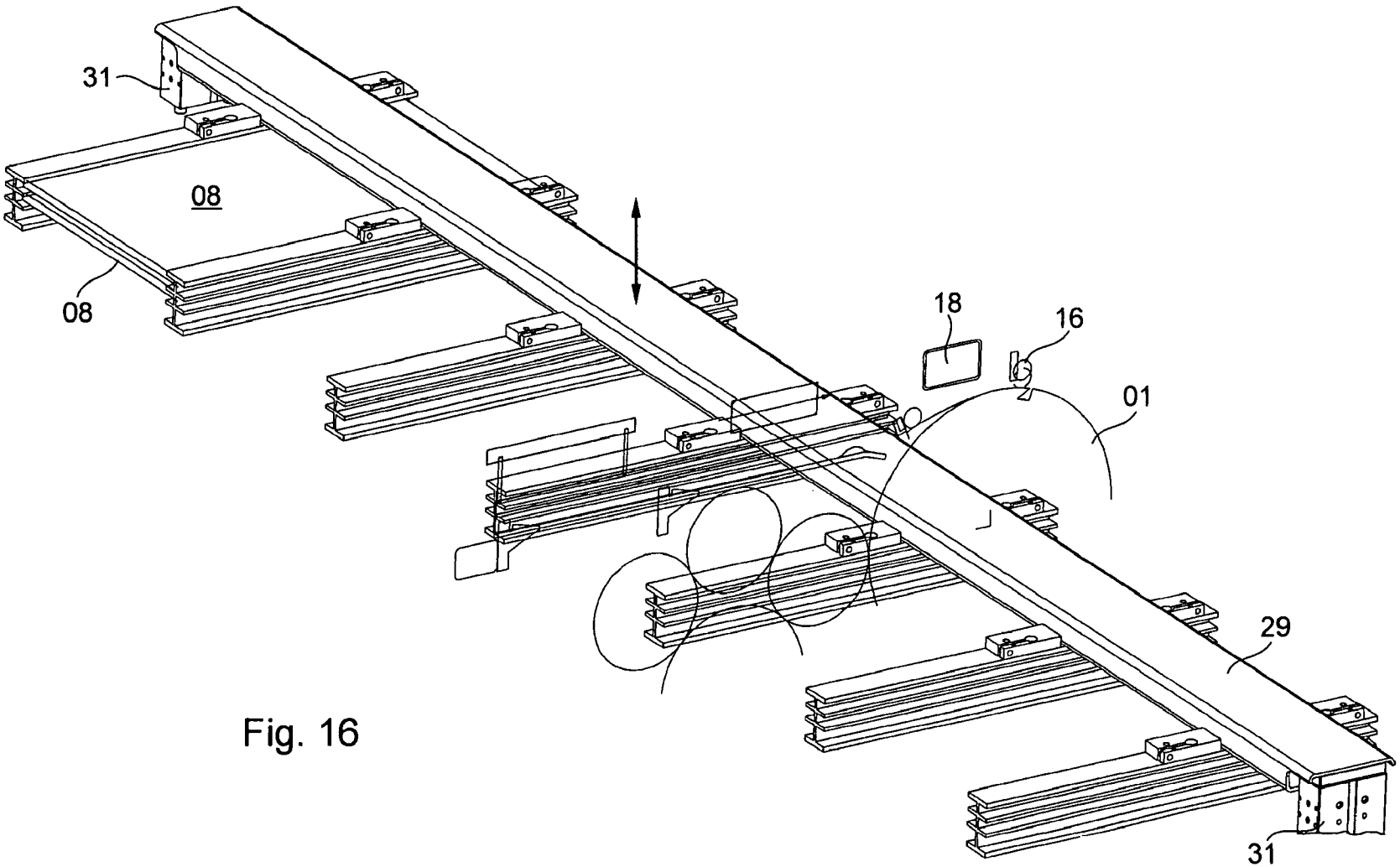
FIGS. 16 and 17 perspective views of a device having a plurality of storage compartments, both one above another and taken in the axial direction of the forme cylinder.
Figure 17:
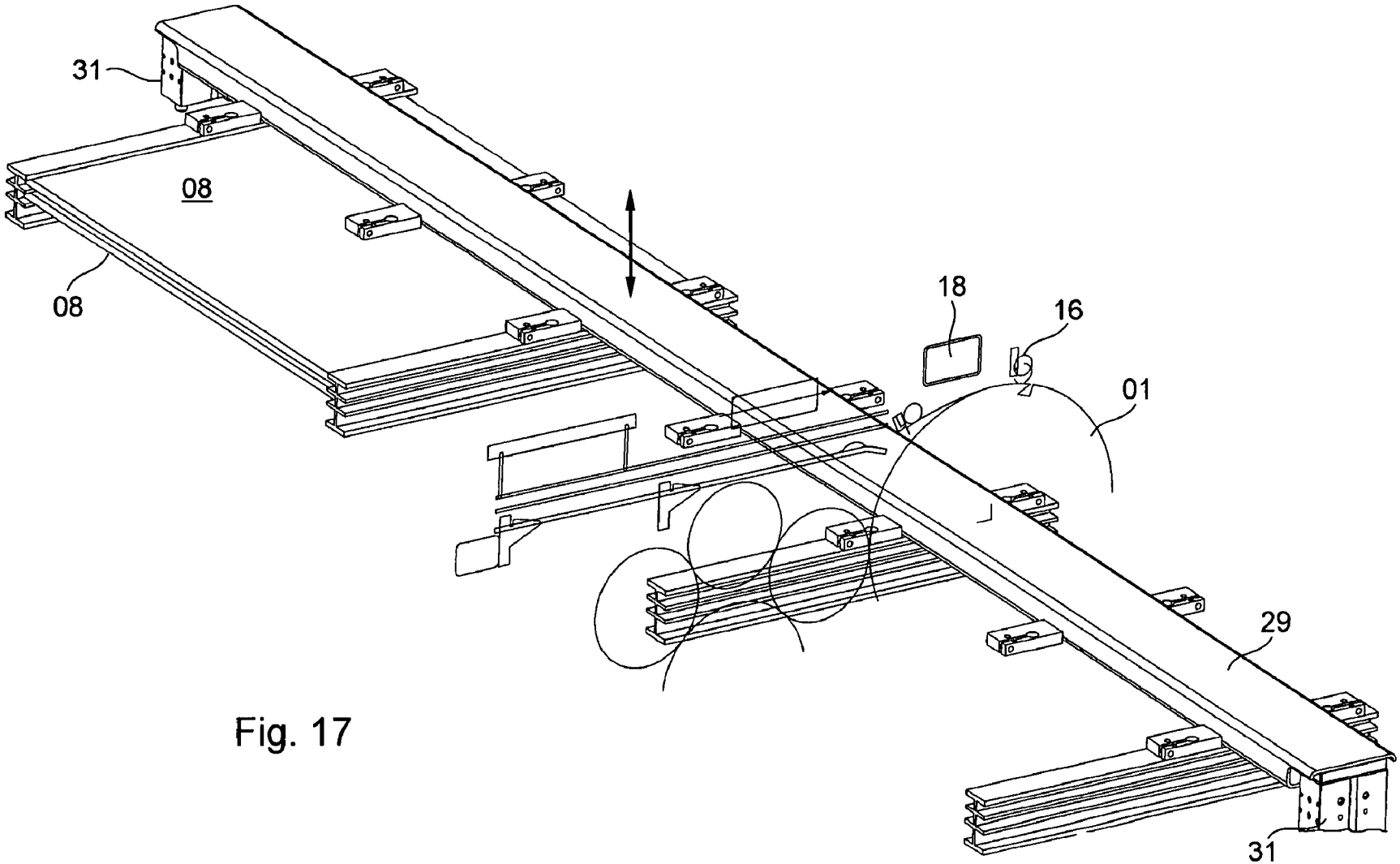

The support surfaces 26; 27; 28 of preferably all of the respective storage compartments 22; 23; 24 are especially rigidly, but each separably connected, for example, to a cross member 29, and preferably to the same cross member 29, which extends axially parallel to the forme cylinder 01. FIG. 16 and FIG. 17 each show a perspective schematic representation of an assembly comprising a plurality of these first, second and third storage compartments 22; 23; 24 which are arranged side by side in the axial direction of the forme cylinder 01. In the example which is schematically shown in FIG. 16, in each case, six printing formes 08 are stored, or at least can be stored, and are arranged side by side in the axial direction of the forme cylinder 01. In the example which is schematically shown in FIG. 17, rather than the six printing formes 08, in each case three double-width printing formes 08 are stored, or at least can be stored, again, oriented side by side in the axial direction of the forme cylinder 01. The double-width printing formes 08 are also called panoramic printing formes 08. To allow such panoramic or double-width printing formes 08 to be stored in each of the respective storage compartments 22; 23; 24, three of the seven support surfaces 26; 27; 28, which are arranged side by side in the axial direction of the forme cylinder 01, must be removed. In each case, it is the center support surface 26; 27; 28 which, in one of each of the three sequences of three support surfaces 26; 27; 28, is arranged directly one in front of another. In other words, in each case, the support surface 26; 27; 28 having an even ordinal number, i.e., the second, fourth and sixth support surfaces 26; 27; 28 in this row of seven support surfaces 26; 27; 28, embodied as guide rails and arranged parallel to one another is the one which must be removed.

The cross member 29, that is shown schematically in FIG. 16 and in FIG. 17, is connected, at each of its opposing end surfaces, to a positioning device 31, and preferably is connected to a lifting device 31. In another preferred embodiment, only a single positioning device 31 may be provided for the purpose of adjusting the spatial position of the cross member 29, and including the storage compartments 22; 23; 24 connected to it, relative to the forme cylinder 01. By synchronously actuating the positioning devices 31, which are shown in FIG. 16 and FIG. 17, the levels of the respective support surfaces 26; 27; 28, each of which is permanently connected to the cross member 29, and thus also the levels of each of the respective storage compartments 22; 23; 24, can be adjusted. In the preferred embodiment, the lifting device 31 raises or lowers the cross member 29, along with the storage compartments 22; 23; 24 attached to it, preferably as a combined unit, in other words, simultaneously in the same lifting process. However, the lifting device 31 must only simultaneously raise or lower at least two, and preferably all, support surfaces 26; 27; 28 that are connected to the cross member 29. The positioning or lifting device 31 therefore adjusts, or can adjust, the respective storage compartments 22; 23; 24 alternatingly, for example, to at least two different stable spatial positions. By use of the positioning device 31, or by use of the at least one positioning device 31, at least one opening area of at least two of the storage compartments 22; 23; 24, with that opening area facing the forme cylinder 01, can be and actually is adjusted, in its respective operating state of engagement against the forme cylinder 01, to the same spatial position relative to the forme cylinder 01 at different points in time. The opening area of a storage compartment 22; 23; 24 extends along a boundary of the relevant storage compartment 22; 23; 24, with that boundary facing the forme cylinder 01 and extending axially along it. This boundary of the relevant storage compartment 22; 23; 24 faces the forme cylinder 01, and thus extends preferably parallel to the width of the printing forme 08 that is or that will be stored in the relevant storage compartment 22; 23; 24, with that width of the printing forme extending in the axial direction of the forme cylinder 01. One of the opening areas of a selected one of the preferably three, vertically stacked storage compartments 22; 23; 24 is therefore adjusted either to the infeed plane of the printing forme 08 that is to be supplied to the forme cylinder 01 or to the infeed plane of the printing forme 08 that is to be removed from the forme cylinder 01. The respective support surface 26; 27; 28, belonging to the relevant storage compartment 22; 23; 24, and depending upon the operational setting of the storage compartment, which is selected using the at least one adjustment device 31, is arranged so that the respective opening area of the relevant storage compartment 22; 23; 24 is positioned at the same spatial position as one of these infeed planes. This thereby allows unimpeded conveyance of the relevant printing forme 08 away from, or up to the forme cylinder 01. This can be accomplished without a staged offset between this respective infeed plane and the relevant storage compartment 22; 23; 24 with the associated support surface 26; 27; 28 in the vertical direction of the respective infeed plane. Each respective infeed plane extends at least between the opening area of the relevant storage compartment 22; 23; 24 and the circumferential surface of the forme cylinder 01. Each such infeed plane is thus located tangentially against the circumferential surface of the relevant forme cylinder 01. A transport path for the printing forme 08 to be loaded or removed, and existing between the relevant storage compartment 22; 23; 24 and the relevant forme cylinder 01, extends, in each case, within or at least along the respective infeed plane. An area that is spanned by the respective support surface 26; 27; 28, such as, for example, an area between a pair of guide rails of the relevant storage compartment 22; 23; 24, which guide rails are arranged spaced from and parallel to one another, and the respective infeed plane of the printing forme 08 that is stored or at least will be stored in this storage compartment 22; 23; 24 therefore have, at least in their transition area, such as, for example, in the opening area of the relevant storage compartment 22; 23; 24, which faces the relevant forme cylinder 01, a continuous, preferably linear shape for the passage of the relevant printing forme 08 that is to be conveyed away from, or up to the forme cylinder 01. Preferably, the at least one positioning device 31 adjusts at least two of the storage compartments 22; 23; 24 as a combined unit, typically along its entire length, and at different times, to the same spatial position relative to the forme cylinder 01. The at least one positioning device 31 thus shifts the respective support surfaces 26; 27; 28 of at least two of the storage compartments 22; 23; 24 parallel with one another. This is the case especially when the relevant support surface 26; 27; 28, with its respective storage compartment 22; 23; 24, is permanently or rigidly connected in the magazine.

The respective storage compartments 22; 23; 24, or at least their respective opening areas, thus have at least a first, for example, a lowered, stable operating position and have a second, for example, a raised, stable operating position. The at least one positioning device 31 can also pivot at least the opening area of each respective storage compartment 22; 23; 24 around a rotational axis that extends in the axial direction of the forme cylinder 01. With this pivoting movement, the positioning device 31 adjusts the desired spatial position of the relevant storage compartment 22; 23; 24, or at least the position of its opening area, relative to the forme cylinder 01. The rotational axis, around which at least the opening area of the respective storage compartment 22; 23; 24 can pivot, is spaced from the boundary of the relevant storage compartment 22; 23; 24, which faces the forme cylinder 01 and extends in the axial direction of the forme cylinder 01.

At least the storage compartments 23; 24 in which the printing formes 08 that are to be loaded sequentially on the same forme cylinder 01 are stored, and preferably all of the storage compartments 22; 23; 24 in this device, which device is engaged against the same forme cylinder 01, preferably form a combined unit, such as, for example, an integrated unit, in which the respective storage compartments 22; 23; 24 of this device are lowered or are raised together. The path of adjustment, which is preferably the stroke of the lifting device 31, is indicated in FIG. 16 and in FIG. 17 by a double arrow. The stroke of the lifting device 31 lies within the range of, for example, a few millimeters, such as, for example, in a range between 5 mm and 30 mm, and especially lies in a range between 10 mm and 20 mm. The lifting device 31 can be embodied, for example, as one or more pneumatic cylinders. The support surfaces 26; 27; 28, which are connected to the cross member 29, can be implemented, for example, as U-shaped guide rails on which the printing formes 08, which are stored in the storage compartments 22; 23; 24, rest. At least one, and preferably both, of their respective edges, that extend parallel to the length of these printing formes 08, are received in the spaced, LL-shaped guide rails.

Figure 2:
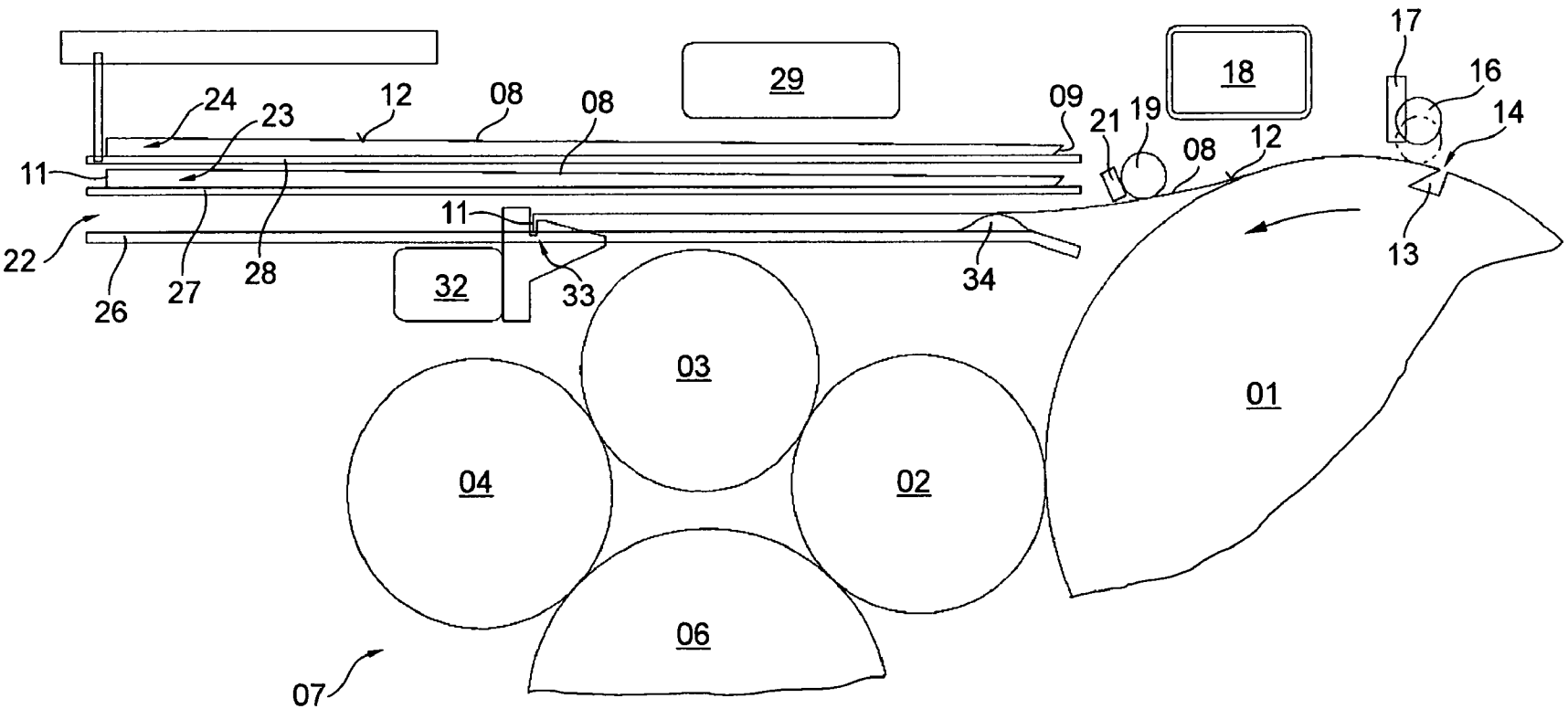

Referring again now to FIGS. 1-15, at least one conveyor device 32, for use in conveying the respective printing forme 08 away from the forme cylinder 01, is provided. This conveyor device 32 conveys a printing forme 08, that is to be loaded into this storage compartment 22, for example, by pulling it, via a movement which is executed along the length of the first storage compartment 22 assigned to the conveying device. This is done once the suspension leg 11, which was located at the trailing end of this printing forme 08, has been released from the opening 14 in the groove 13 and has been fed to the opening of this first storage compartment 22 as a result of a rotational movement of the forme cylinder 01, optionally with the assistance of the guide element 19, as may be seen in FIG. 1. The rotational movement of the forme cylinder 01 is indicated in FIG. 1 by a rotational direction arrow. The conveyor device 32 has a carrier 33, which may be embodied, for example, as a latch, and in which carrier 33 the suspension leg 11, which is situated at the trailing end of the printing forme 08 to be loaded, engages, and especially snaps into, as a result of the rotational movement of the forme cylinder 01. Once the carrier 33 of the conveyor device 32 has gripped the trailing suspension leg 11, which is located at the trailing end of the printing forme 08 that is to be removed 08, the carrier 33 is moved by the conveyor device 32 from a position which is close to the forme cylinder 01 to a position which is distant from the forme cylinder 01. This movement results in the removal of the printing forme 08 that is to be removed completely from the forme cylinder 01 lengthwise. The removed printing forme 08 is drawn into the first storage compartment 22, as seen in FIG. 2 and in FIG. 3. FIG. 2 shows the printing forme 08 during its removal from the forme cylinder 01, whereas FIG. 3 shows the printing forme 08 having been completely removed.

Figure 3:
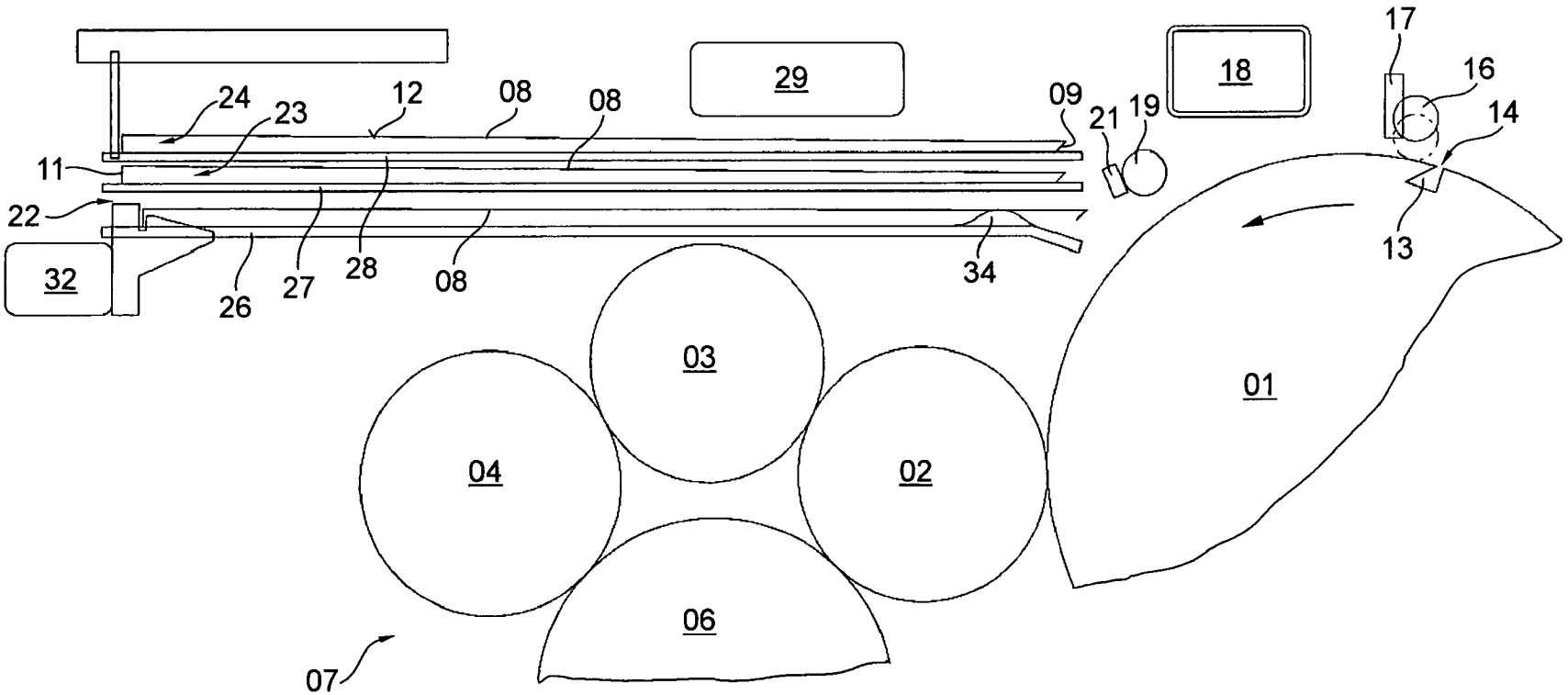

In the opening area of the first storage compartment 22, and specifically at its end that faces the forme cylinder 01, a ramp 34 can be provided, on which ramp 34 the leading end of the printing forme 08 rests when this printing forme 08 is stored in the first storage compartment 22, as is seen in FIG. 3. The closest position of the carrier 33 of the conveyor device 32, with respect to the forme cylinder 01, and when the printing forme 08 is to be removed, is located, for example, approximately halfway along the length of the printing forme 08 which is to be stored in this first storage compartment 22. In order to support the release of the preferably acutely angled suspension leg 09 at the leading end of this printing forme 08, that is eventually to be removed from the groove 13 of the forme cylinder 01, it can be provided that, once the trailing end of the printing forme 08, which is to be removed from the forme cylinder 01, has been introduced into the first storage compartment 22, at least this first storage compartment 22 is lowered relative to a spatial position of the forme cylinder 01 defined by the cylinder groove 13. This lowering of the first storage compartment may be accomplished by actuating the at least one lifting device 31, so that a bending stress is exerted on the front end of this printing forme 08 to be removed.

Figure 4:
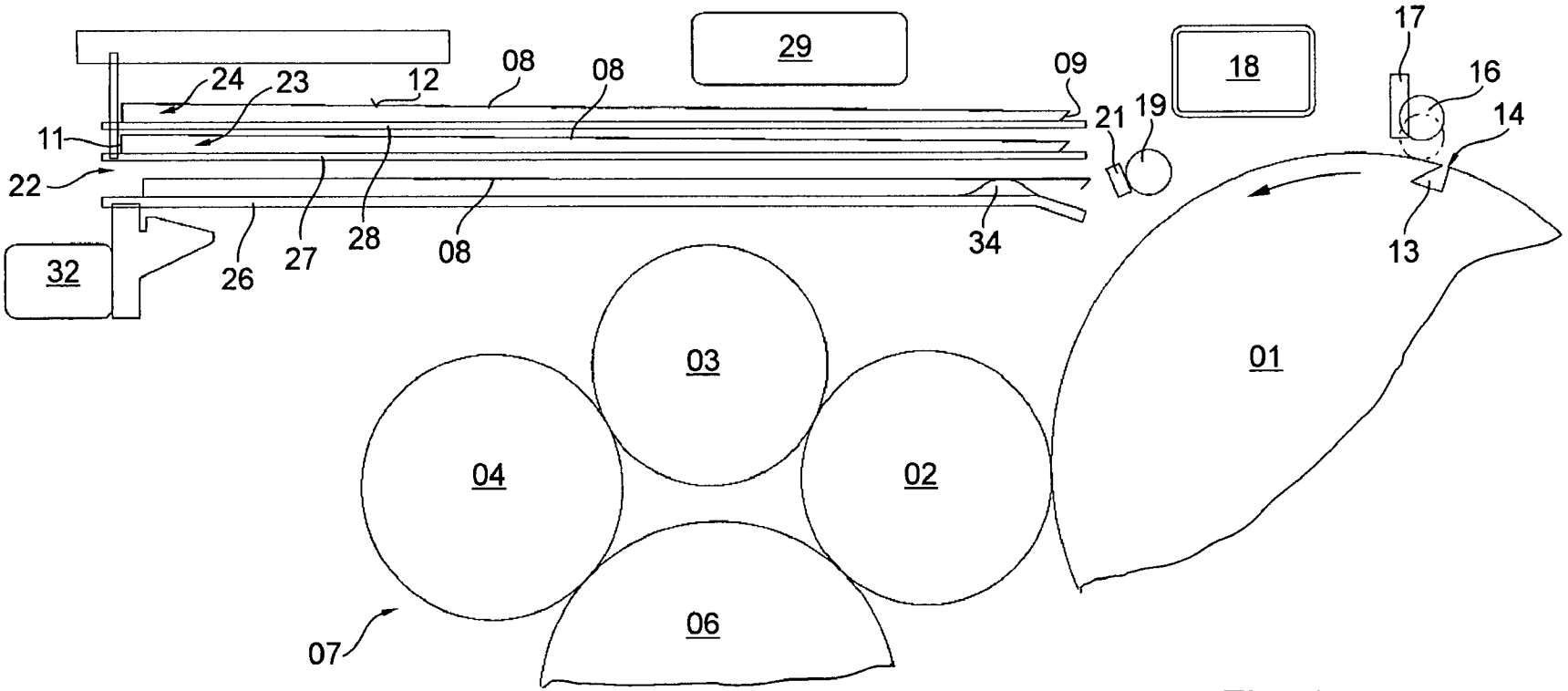
Figure 5:
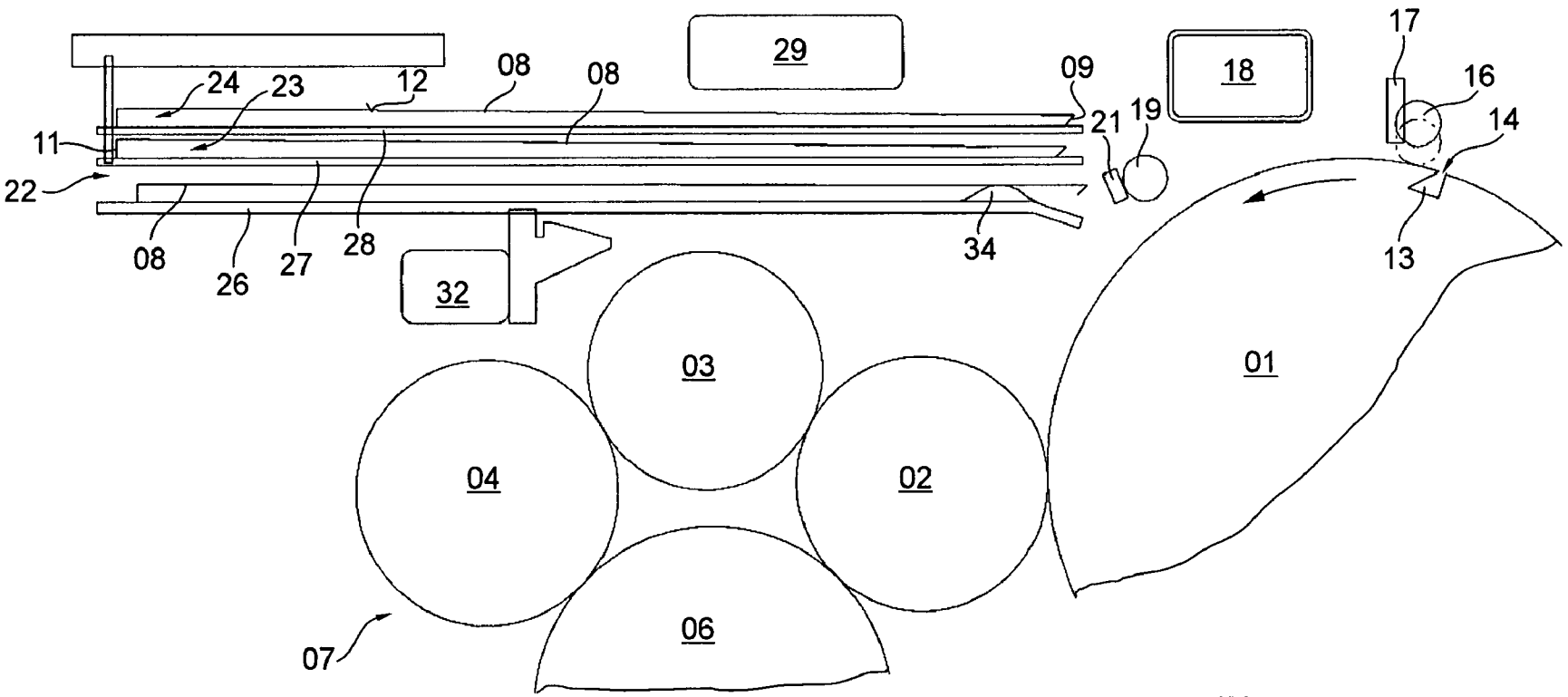
Figure 6:
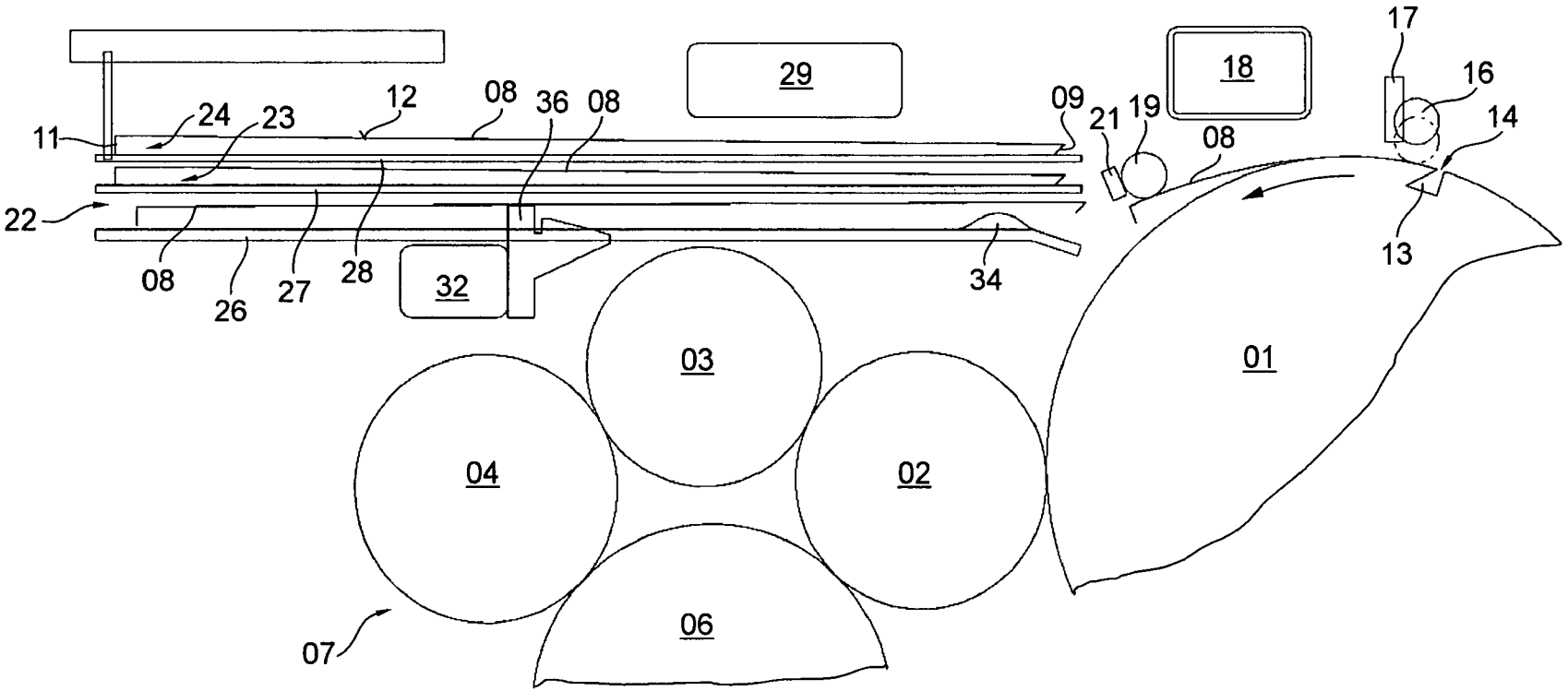
Figure 7:
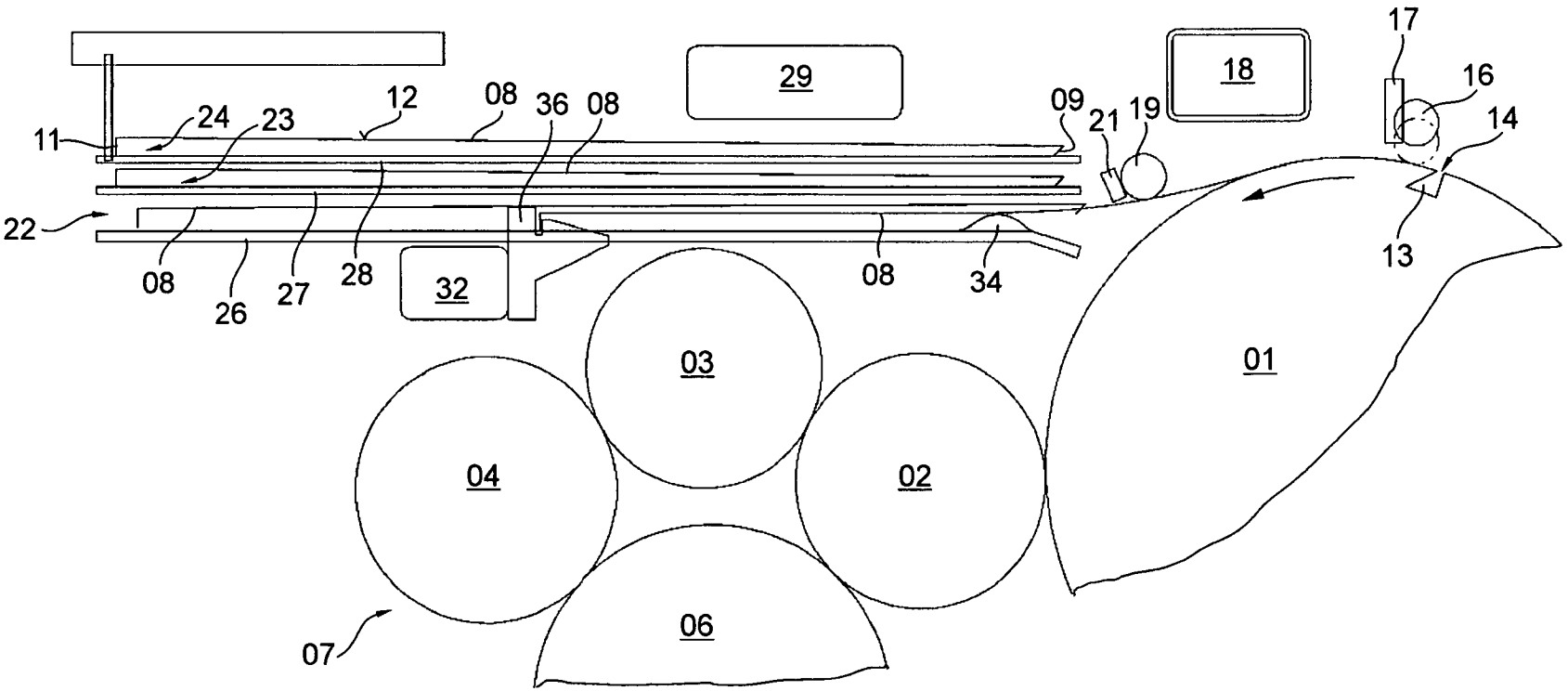
Figure 8:
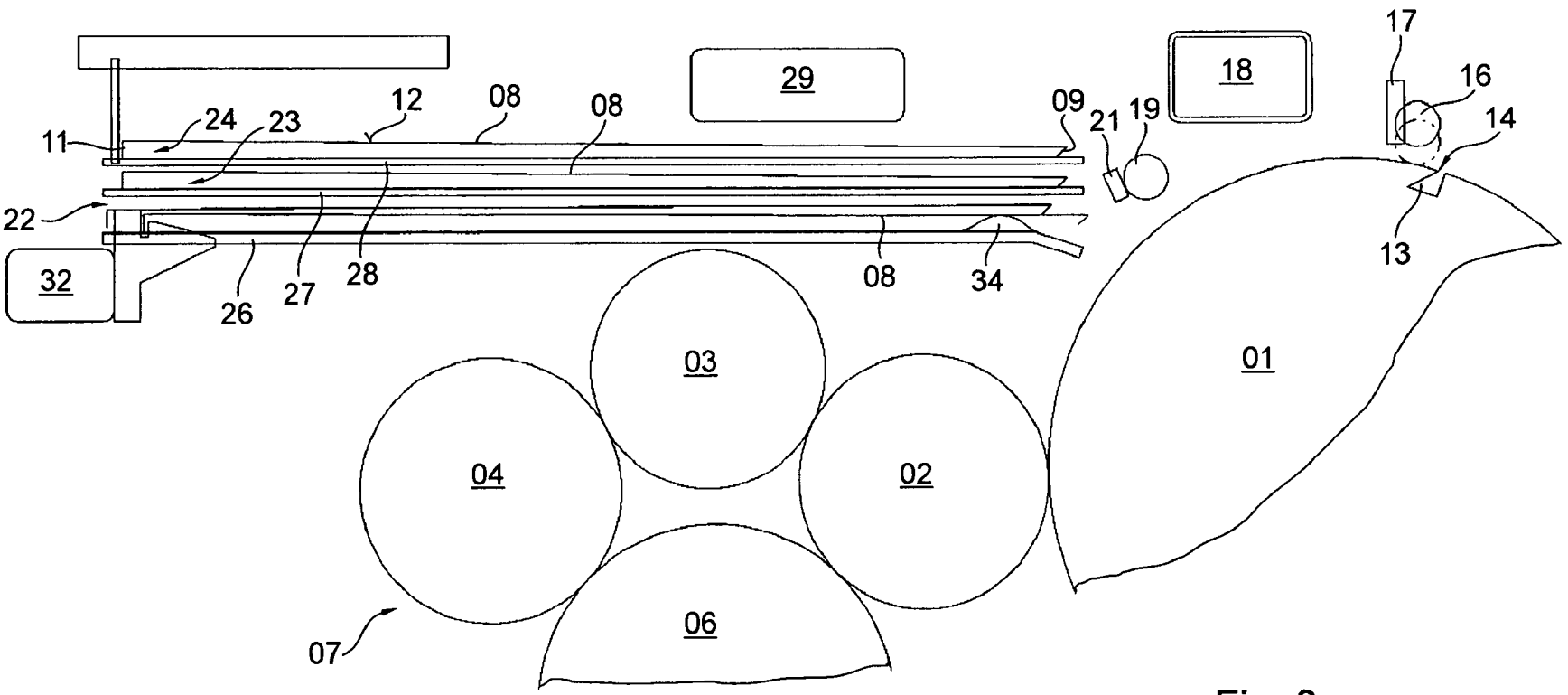
Figure 9:
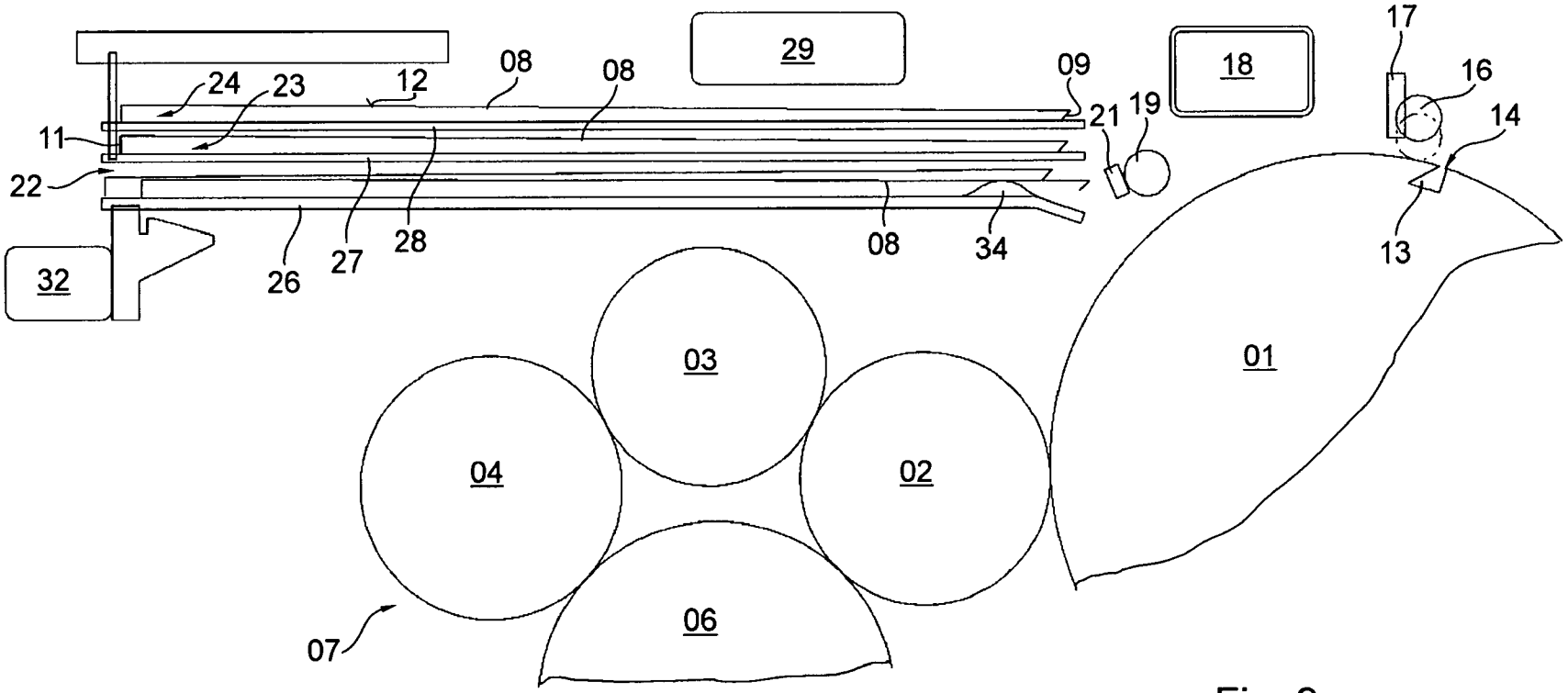
Figure 10:
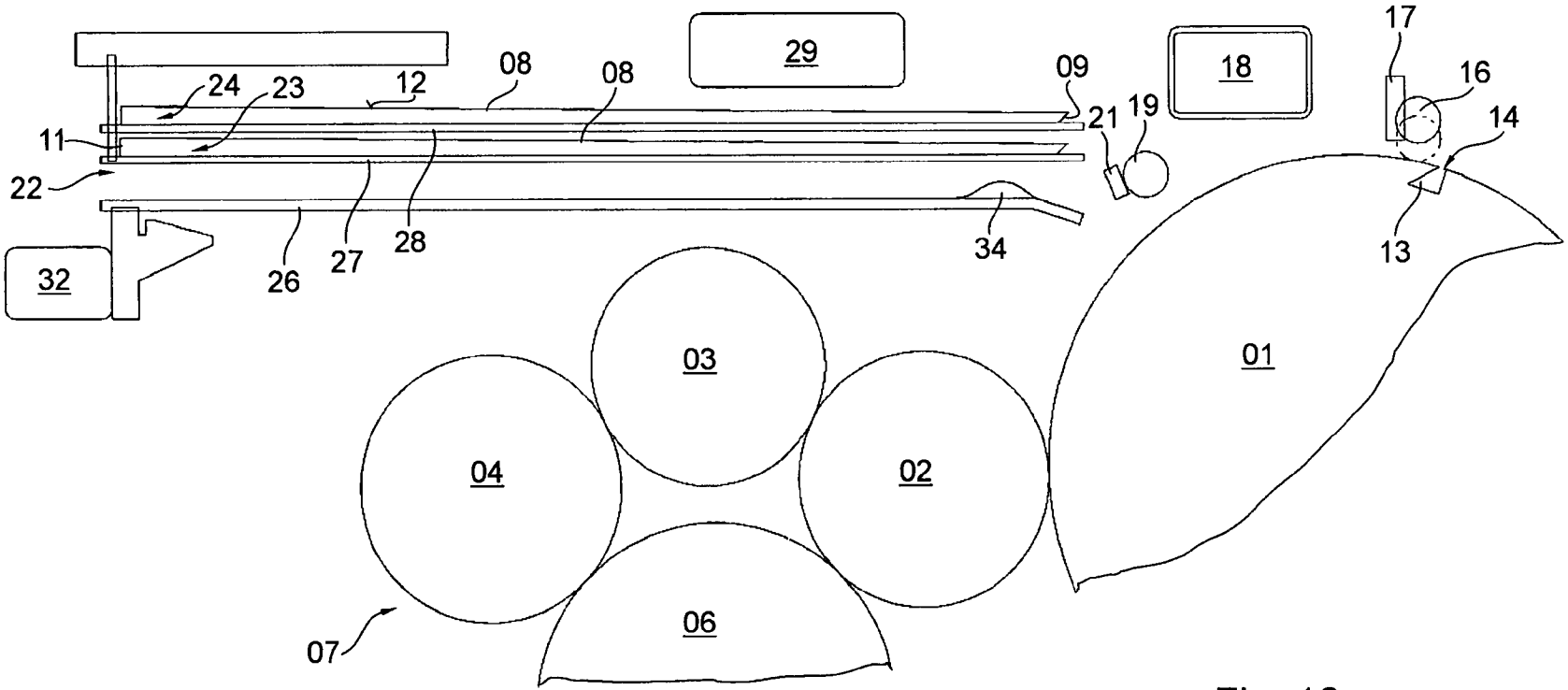

Once the printing forme 08 that is to be removed has preferably been completely drawn lengthwise into the first storage compartment 22, at least this first storage compartment 22 is raised to another level. This elevating of the first storage compartment 22 may be accomplished especially by actuating the at least one lifting device 31 of the cross member 29. The result is that the suspension leg 11 at the trailing end of the printing forme 08 to be removed becomes unlatched from the carrier 33 of the conveyor device 32 which remains stationary, as seen in FIG. 4. The carrier 33 of the conveyor device 32 can then be moved back to its position close to the forme cylinder 01, which position is depicted in FIG. 5. If a second printing forme 08 is to be removed from the same axial position on the forme cylinder 01, this second printing forme 08 is released from the forme cylinder 01 at its trailing end 11, as was described above, and is also fed to the first storage compartment 22. In this case, at least this first storage compartment 22 is now again lowered to its lower level, such as for example, by re-actuating the at least one lifting device 31 of the cross member 29. The carrier 33 of the conveyor device 32 now again projects into the first storage compartment 22, as is depicted in FIG. 8. The carrier 33 of the conveyor device 32 can have a ram 36, with which the removed printing forme 08, which has already been stored in the first storage compartment 22 can be elevated. The result is that the already removed printing forme 08 is raised such that the leading end of this previously removed and stored printing forme 08 is raised from its position of rest an the ramp 34. The trailing end of the second printing forme 08, that is to be removed from the forme cylinder, can then be pushed, by the rotational movement of the forme cylinder 01, under the leading end of the first, previously removed printing forme 08 that has already been stored in the first storage compartment 22. The suspension leg 11 at the trailing end of the second printing forme 08 to be removed is moved into the storage compartment 22 until it is engaged on the carrier 33 of the conveyor device 32, as is depicted in FIG. 7. The second printing forme 08 to be removed from the forme cylinder 01 is then drawn all the way into the first storage compartment 22 by a movement of the carrier 33 of the conveyor device 32 to its position distant from the forme cylinder 01. The second printing forme 08 to be removed is stored below the first removed printing forme 08 that was first stored in the first storage compartment 22. The leading end of the second removed printing forme 08 is now resting on the ramp 34, as seen in FIG. 8. The first storage compartment 22 is now raised back up to its higher level, by a further actuation of the at least one lifting device 31 of the cross member 29. The suspension leg 11 at the trailing end of the second printing forme 08 to be removed now also becomes unlatched from the carrier 33 of the conveyor device 32, as may be seen in FIG. 9. The removal process has now been completed for a specific axial position of the forme cylinder 01. The two removed printing formes 08 that have now been stored in the first storage compartment 22 can be removed from the magazine, for example by staff who are operating the rotary printing press. The first storage compartment will thus be rendered empty, as may be seen in FIG. 10.

By utilizing the above-described plate removal process, for example, the two mounting positions, which are provided at the same axial position on the forme cylinder 01, and which are situated one in front of another in the forme cylinder's circumferential direction, for example, are vacated. These two mounting positions can now each be loaded with a new printing forme 08 in a subsequent plate loading process. For this purpose, one printing forme 08 to be loaded can stored in the second storage compartment 23 and a second printing forme 08 can be stored in the third storage compartment 24, all as seen in FIG. 11; in FIG. 16; and in FIG. 17.

The plate removal process has been described above within the context of an embodiment in which the level of the first storage compartment 22 can be changed by actuating the at least one lifting device 31 of the cross member 29. However, because the execution of the above-described functions involves only a relative movement between the first storage compartment 22 and especially the carrier 33 of the conveyor device 32, as an alternative to the above-described embodiment, the level of this carrier 33 of the conveyor device can also be adjustable relative to a stationary first storage compartment 22. For executing functions, with respect to a printing forme 08 to be loaded, and which printing forme 08 to be loaded is stored in the second storage compartment 23 or in the third storage compartment 24, a forme advancing mechanism 37 is provided. A level of the forme advancing mechanism 37, which is indicated by reference numeral in FIG. 11, is adjustable relative to these second and third storage compartments 23; 24. The relative movement between the advancing mechanism 37 and the storage compartments 23; 24 will be described, by way of example, in the discussion which follows, again within the context of an actuation of the at least one lifting device 31 of the cross member 29.

Figure 11:
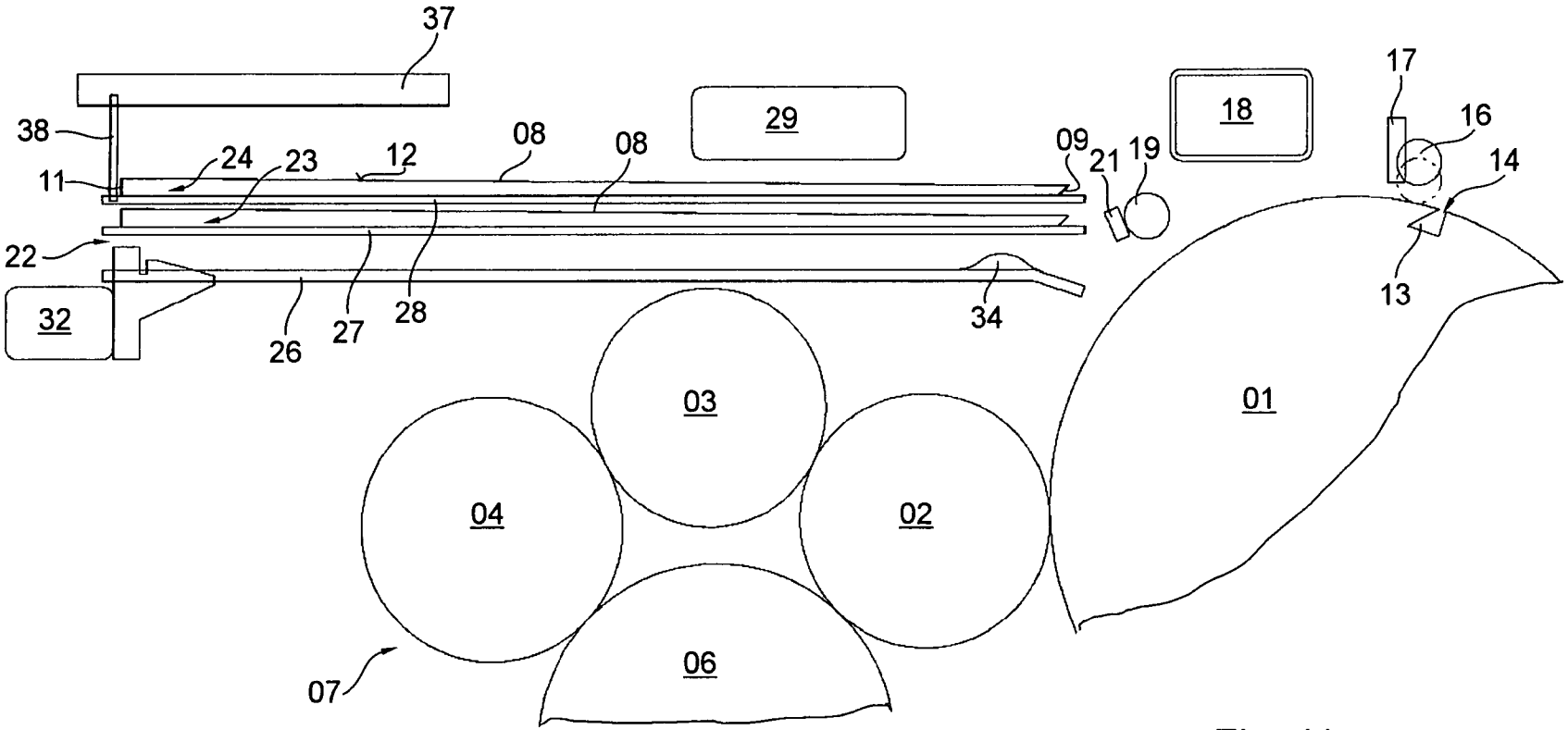
FIG. 11 to 15 various individual steps of a plate removal process.
Figure 12:
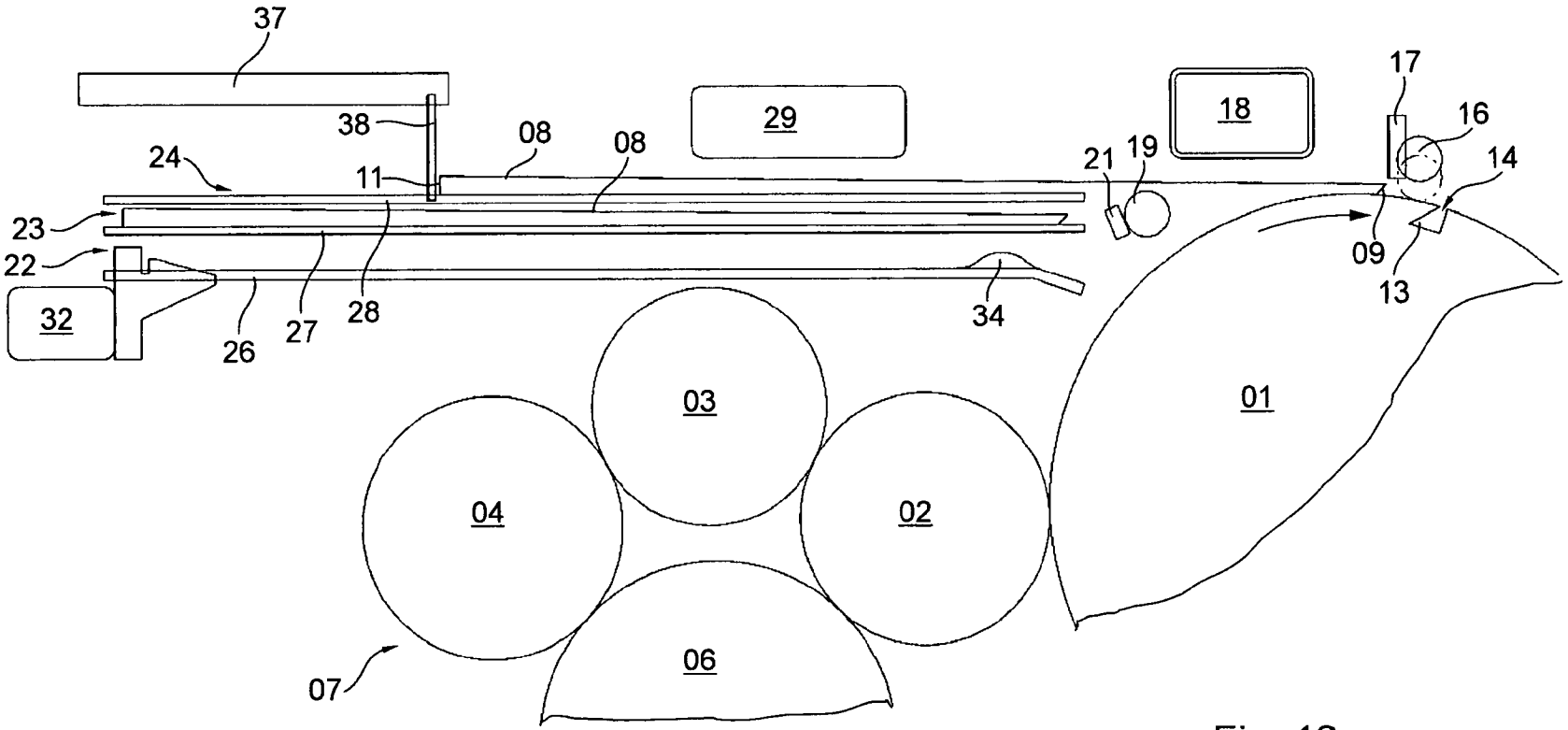
Figure 13:
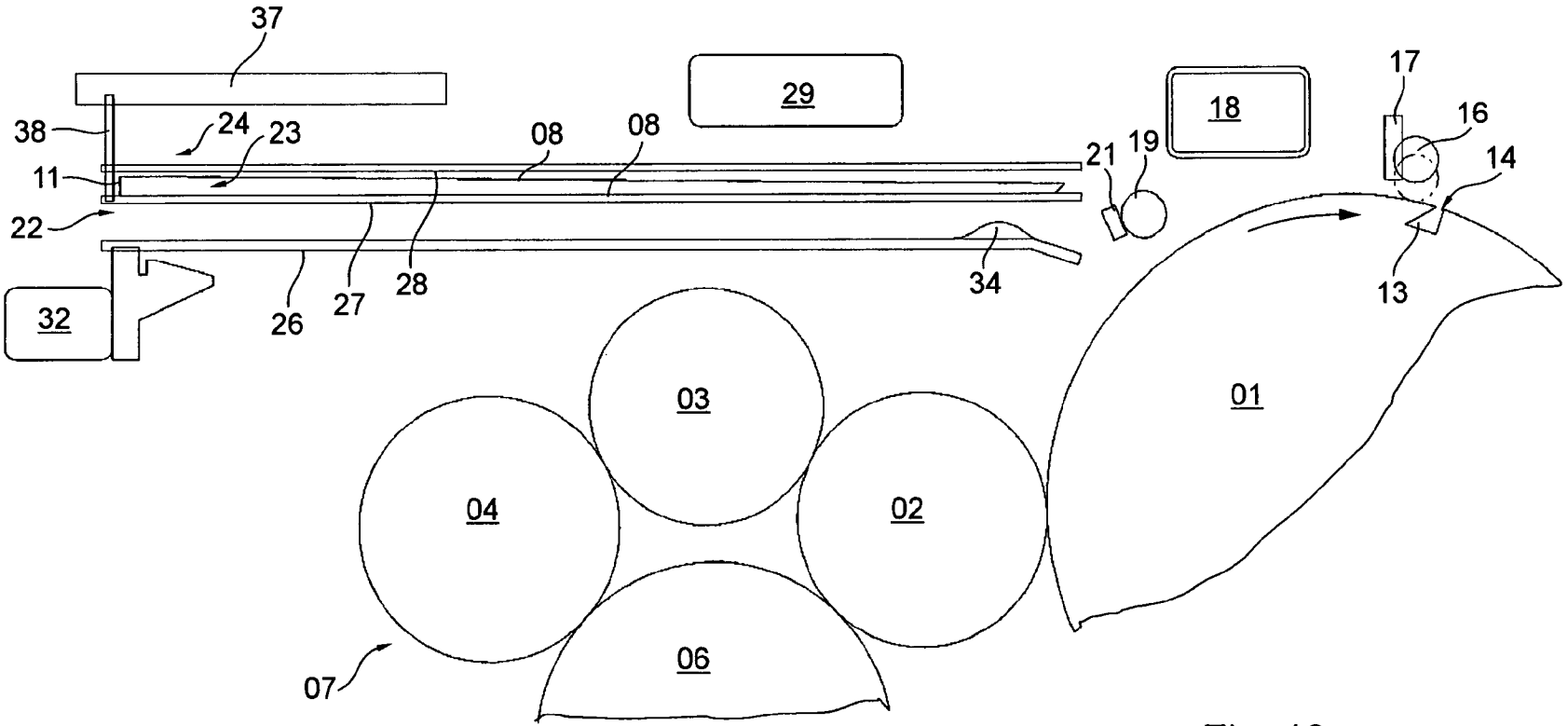
Figure 14:
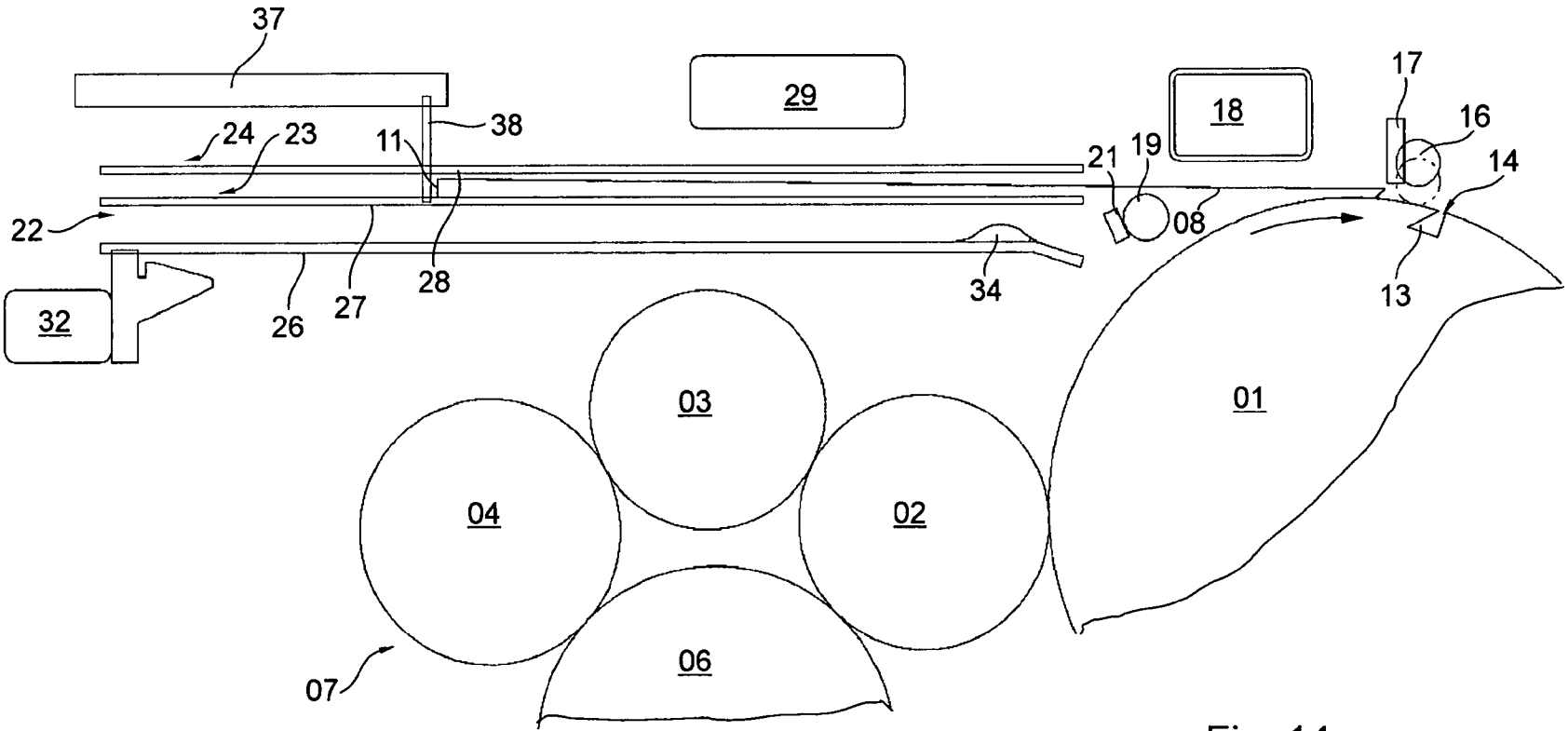

The advancing mechanism 37, as may be seen in FIG. 11, has a sliding element 38, which first engages solely on the printing forme 08, which is stored in the third, uppermost storage compartment 24, and preferably engages the suspension leg 11 at the trailing end of the printing forme 08 which is stored in this third storage compartment 24. This engagement is a result of the selected level between the advancing mechanism 37 and the storage compartments 23; 24. The sliding element 38, which is connected to the advancing mechanism 37, projects vertically, for example, into the third storage compartment 24. The advancing mechanism 37, when it is actuated, exerts a thrust force via its slider element 38 on this printing forme 08, with that thrust force being directed parallel to the longitudinal direction of the printing forme 08 to be loaded. This thrust force is applied in order to feed this printing forme 08 toward the forme cylinder 01. Such a forward feeding is continued until the angled suspension leg 09, at the leading end of this printing forme 08 to be loaded, engages in one of the openings 14 in one of the two grooves 13 of the forme cylinder 01, which two grooves are arranged offset 180° from one another, as seen in FIG. 11, and in FIG. 12. The advancing mechanism 37 thus moves its slider element 38 from a position that is initially relatively distant from the forme cylinder 01 to a position that is relatively closer to the forme cylinder 01. This relatively closer position is located in the area of the rear half, or even in the area of the rear third of the printing forme 08 to be loaded, and which printing forme 08 is preferably stored lengthwise in the third storage compartment 24. Once the suspension leg 09 at the leading end of this printing forme 08 to be loaded becomes hooked on the forme cylinder 01, the forme cylinder 01 then rotates in the direction which is indicated in FIG. 12 by a directional arrow. This rotation is effective in drawing the printing forme 08 to be loaded onto the circumferential surface of the forme cylinder 01. The plate loading process can be supported by the at least one contact pressure element 16 which may be engaged against the circumferential surface of the forme cylinder 01.

Once the printing forme 08 to be loaded, which was previously stored in the third storage compartment 24, has been fed to the forme cylinder 01, the level of the slider element 38 is adjusted relative to the second storage compartment 23. Preferably, by actuating the at least one lifting device 31 of the cross member 29, this second storage compartment 23 is raised relative to the advancing mechanism 37, preferably as an integrated unit. The slider element 38, that is connected to the advancing mechanism 37, now engages against the printing forme 08 which is stored in the second storage compartment 23, and preferably engages against the suspension leg 11 at the trailing end of this printing forme 08 which is stored in this second storage compartment 23. This engagement occurs with the slider element preferably situated in its position distant from the forme cylinder 01, as may be seen in FIG. 13. When it is actuated, the advancing mechanism 37 then exerts, via its slider element 38, a thrusting force on the printing forme 08 to be loaded. That thrusting force is directed parallel to the longitudinal direction of this printing forme 08, and is exerted in order to feed this printing forme 08 to the forme cylinder 01 in the same manner as was described above in reference to FIG. 11 and to FIG. 12. Movement of the slider element 38 continues in the direction toward the forme cylinder 01 until the angled suspension leg 09 at the leading end of this printing forme 08 to be loaded on the forme cylinder 01 engages in one of the openings 14 in one of the grooves 13 of the forme cylinder 01. Once this suspension leg 09 at the leading end of this printing forme 08 to be loaded becomes hooked on to the edge of the groove opening 14, the forme cylinder 01 again rotates in the direction indicated by a directional arrow in FIG. 14. This rotation draws the printing forme 08 to be loaded onto the circumferential surface of the forme cylinder 01. The plate loading process can also be supported by the use of the at least one contact pressure element 16 that is engaged against the circumferential surface of the forme cylinder 01. When a plurality of printing formes 08 are to be supplied to the forme cylinder 01 from different storage compartments 23; 24, the slider element 38 of the advancing mechanism 37 always feeds the printing forme 08 that is stored in the one of the several storage compartment 23; 24 which requires the shortest adjustment path for the lifting device 31 to the forme cylinder 01 first. In other words, the slider element 38 of the advancing mechanism 37 projects at different depths into the device with the storage compartments 23; 24, depending upon, for example, the selected spatial position of this device. In each case, the slider element 38 can optionally be placed in active connection with the suspension leg 11 of one of the printing formes 08 to be loaded by lowering that slider element relative to the storage compartment 23; 24 or by raising the storage compartment 23; 24 relative to the slider element 38.

Figure 15:
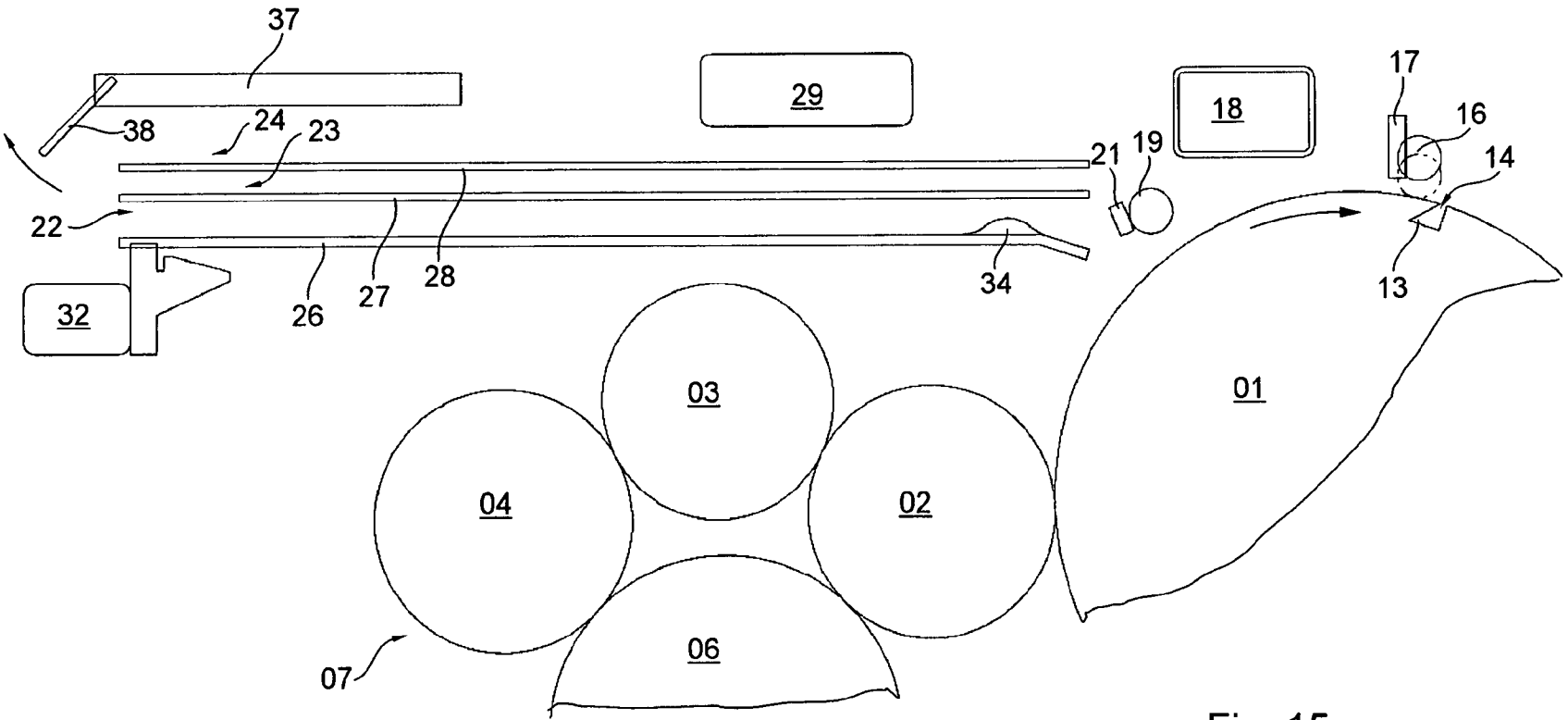

Once the respective printing formes 08 that are stored in each of the storage compartments 23; 24 have been fed to the forme cylinder 01 and have been mounted on the forme cylinder 01, the slider element 38 that is connected to the advancing mechanism 37 is preferably moved back to its position that is more distant from the forme cylinder 01. Slider element 38 may then be pivoted, for example, by a rotation of 45° or more away from the forme cylinder 01, for example, as is indicated in FIG. 15 by a directional arrow. The storage compartments 23; 24 now become accessible for loading with new printing formes 08. A new plate removal process and/or plate loading process, as has been described above, can then begin.

The present invention is characterized in that, either the at least one positioning device 31 adjusts at least one opening area, with that opening area facing the forme cylinder 01, of at least two of the storage compartments 22; 23; 24, in its respective operating state of engagement against the forme cylinder 01, to the same spatial position relative to the forme cylinder 01 at different points in time, or alternatively, in that the at least one lifting or positioning device 31 raises the respective storage compartment 22; 23; 24 relative to the carrier 33 and/or relative to the slider element 38, or lowers the carrier 33 and/or the slider element 38 relative to the respective storage compartment 22; 23; 24. In the first embodiment of the present invention, the relevant storage compartments 22; 23; 24 are preferably adjusted, as a combined unit, to the same spatial position relative to the forme cylinder 01 at different points in time by adjusting the integrated unit provided by the magazine. In the second embodiment, in each of its two variations, a relative movement, which is directed preferably orthogonally to the relevant storage compartment 22; 23; 24, is executed between this at least one storage compartment 22; 23; 24 and the carrier 33 and/or slider element 38 which is assigned to it. In this case, the at least one lifting or positioning device 31 preferably raises the respective storage compartment 22; 23; 24 as a combined unit relative to the carrier 33 and/or slider element 38.

FIG. 18 through FIG. 24 show various arrangements of a device in accordance with the present invention, and as described above, in connection with FIG. 1 through FIG. 17, with a plurality of storage compartments 22; 23; 24, and especially with three such storage compartments, in variously configured printing units.

Figure 18:
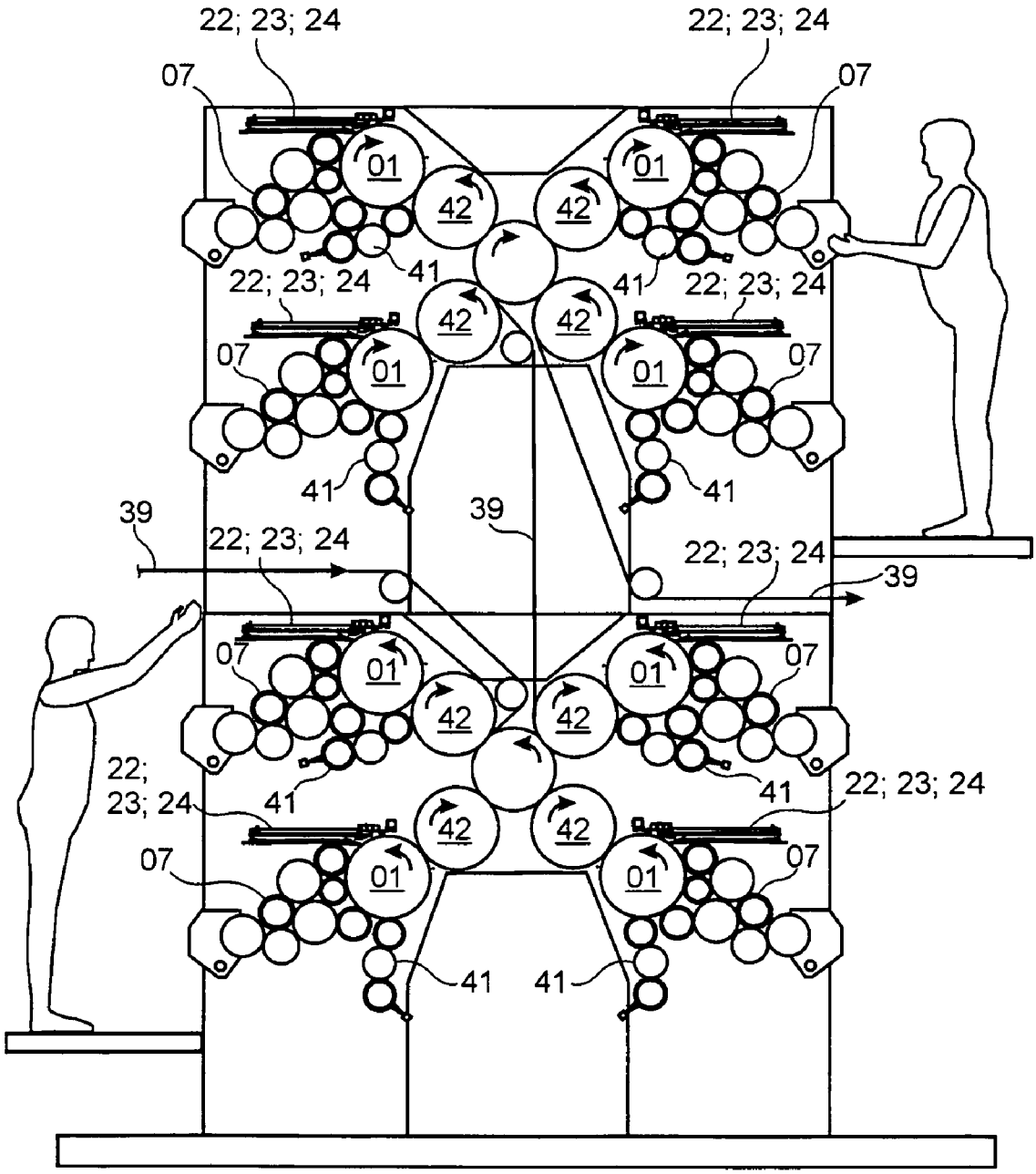
FIG. 18 to 24 schematic side elevation views of various arrangements of the device in accordance with the present invention and having a plurality of storage compartments, and showing the device in cooperation with various printing unit variations.

FIG. 18 schematically depicts a printing tower with two nine-couple satellite printing units arranged one above another. A device having a plurality of storage compartments 22; 23; 24 is arranged tangentially, in a horizontal alignment, on each forme cylinder 01. The three storage compartments 22; 23; 24 are always arranged one above another in a stack or in a layered assembly. A path of a print substrate 39, and especially a web of material 39, and preferably a web of paper 39, which is guided through the printing units, and the respective rotational direction of the printing couple cylinders, in their production direction, are each indicated by a rotational direction arrow. All of the printing couple cylinders are at least approximately the same size in diameter. The forme cylinders 01 and the transfer cylinders 42, which are respectively assigned to them, are each embodied as double-sized cylinders. Two printing formes 08 can thus be arranged around the periphery of each respective forme cylinder 01 in the circumferential direction. An inking unit 07 and a dampening unit 41 are engaged against each respective forme cylinder 01. The inking units 07 each have a roller train comprised of a plurality of rollers 02; 03; 04; 06, as may be seen by referring back to FIG. 1.

Figure 19:
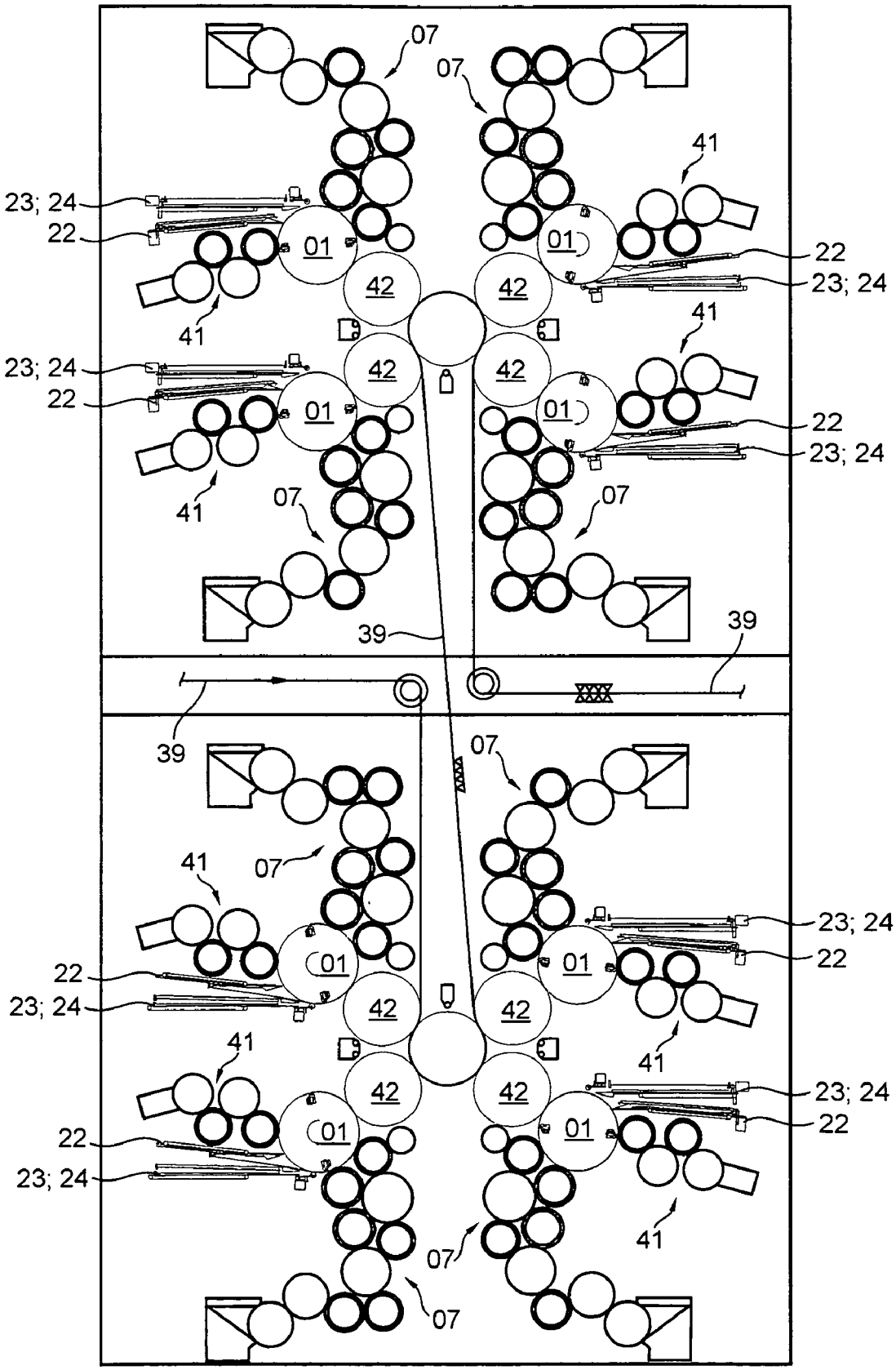

FIG. 19 also shows a printing tower with two nine-cylinder satellite printing units arranged one above the other. The forme cylinders 01 and the transfer cylinders 42, which respectively are assigned to each satellite printing unit, are each embodied as double-sized cylinders. An inking unit 07 and a dampening unit 41 are engaged against each respective forme cylinder 01. The inking units 07 each have a roller train which is preferably comprised of a plurality of rollers 02; 03; 04; 06. All the printing couple cylinders are at least approximately the same size in diameter. In contrast to the devices represented in FIG. 18, and which are provided with the plurality of storage compartments 22; 23; 24, in this embodiment, only the second storage compartment 23 and the third storage compartment 24 form an integrated unit. The first storage component 22, which receives the removed printing formes, is arranged separately and is positioned at an inclination of preferably less than 30°, for example, in relation to the other two storage compartments 23; 24. The second storage compartment 23 and the third storage compartment 24 are arranged horizontally, for example, and preferably are positioned in a tangential alignment in relation to the forme cylinder 01. The first or used plate storage compartment 22 can be arranged below or above the other two storage compartments 23; 24. Depending upon the installation conditions in the printing couple, the respective device and the plurality of storage compartments 22; 23; 24 can also be arranged in a reverse sequence to the representations of FIG. 1 to FIG. 17, in some cases even arranged upside down, on the respective forme cylinder 01.

Figure 20:
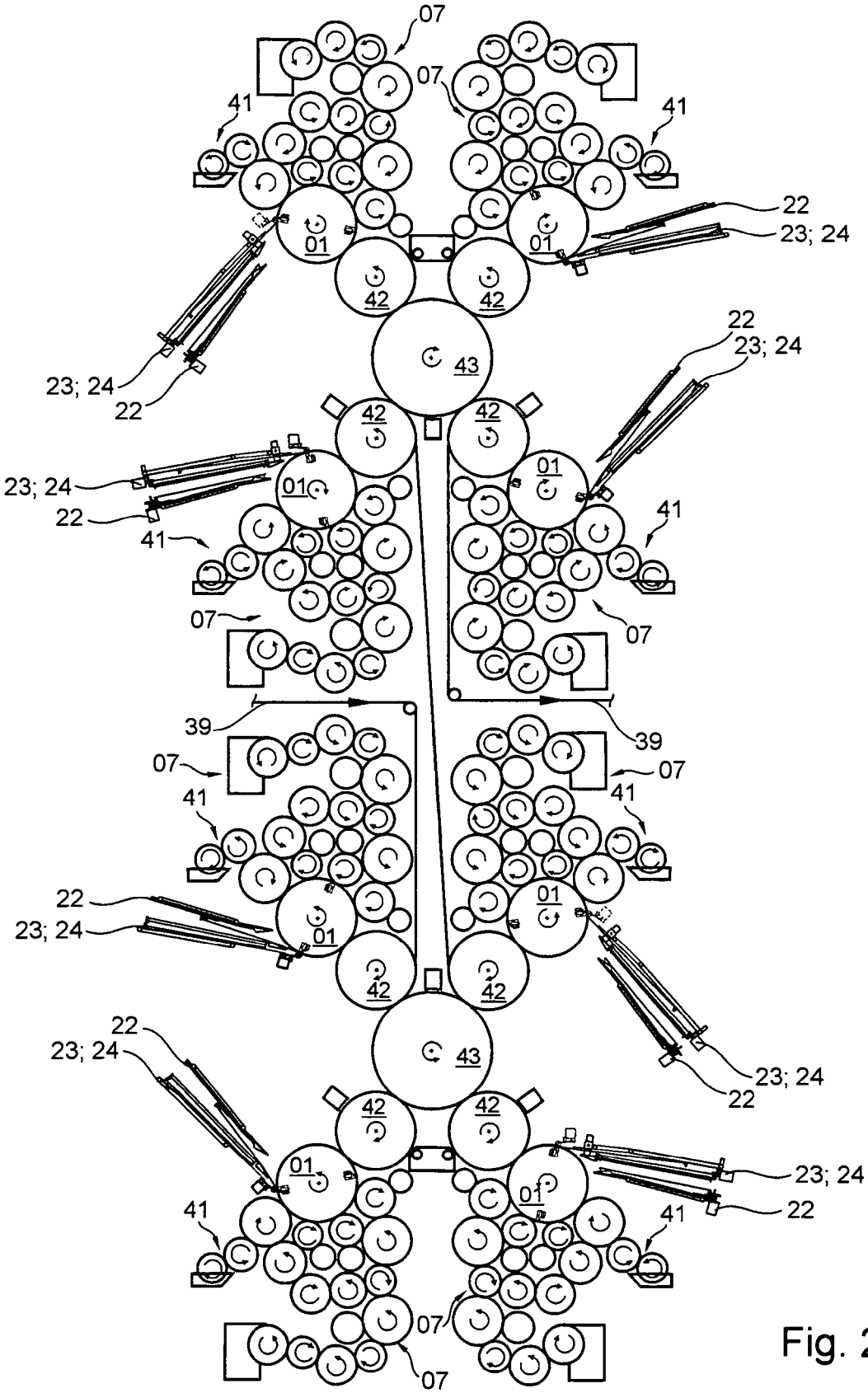

FIG. 20 also shows a printing tower with two nine-cylinder satellite printing units which are arranged one above the other. The forme cylinders 01, and the transfer cylinders 42 which are respectively assigned to them, are each embodied as double-sized cylinders. An inking unit 07 and a dampening unit 41 are engaged against each respective forme cylinder 01. In FIG. 20, the respective rotational directions of the printing couple cylinders, and of the rollers which are provided for production operation are each indicated by rotational direction arrows. In contrast to the printing units shown in FIG. 18 and FIG. 19, the diameter of the impression cylinder 43 in the two nine-cylinder satellite printing units of FIG. 20 is approximately 50% larger than that of the four transfer cylinders 42 which are engaged against it. In the printing units shown in FIG. 20, as in the printing units which are shown in FIG. 19, in the devices having the plurality of storage compartments 22; 23; 24, only the second storage compartment 23 and the third storage compartment 24 form an integrated unit. The first storage compartment 22 is arranged separately and at an inclination of preferably less than 30°, for example, in relation to the other two storage compartments 23; 24. The first storage compartment 22 can be arranged either below or above the other two storage compartments 23; 24. The second storage compartment 23 and the third storage compartment 24 are preferably arranged in a tangential alignment relative to the forme cylinder 01.

They are engaged against the respective forme cylinder 01 at an angle of inclination of between 15° and 75°, and preferably of between 40° and 60°, from the horizontal.

Figure 21:
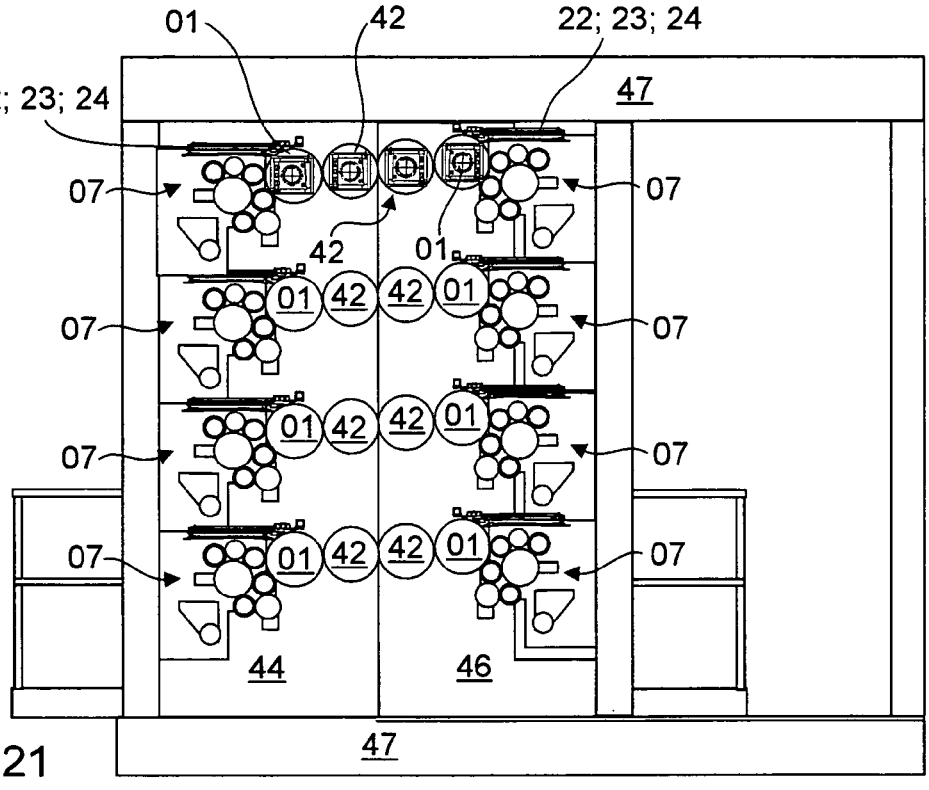
Figure 22:
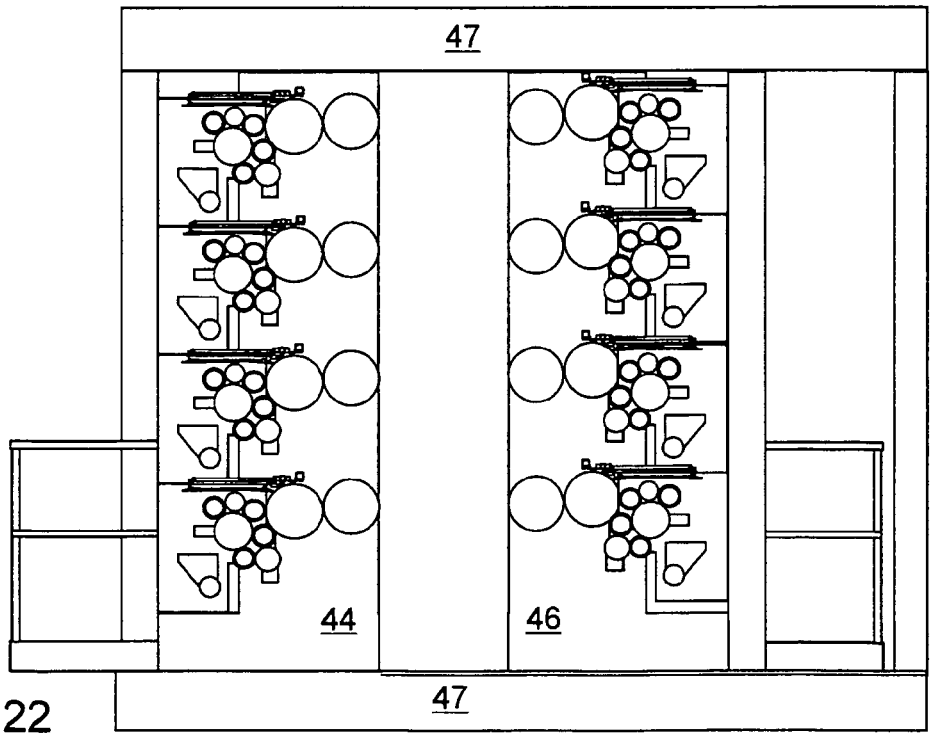
Figure 23:
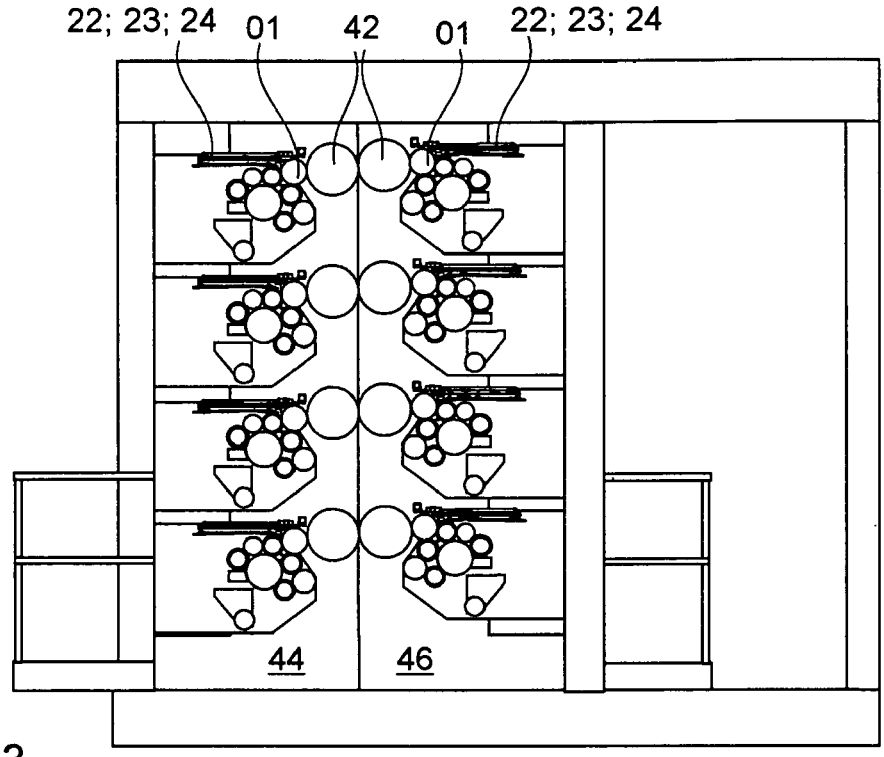
Figure 24:
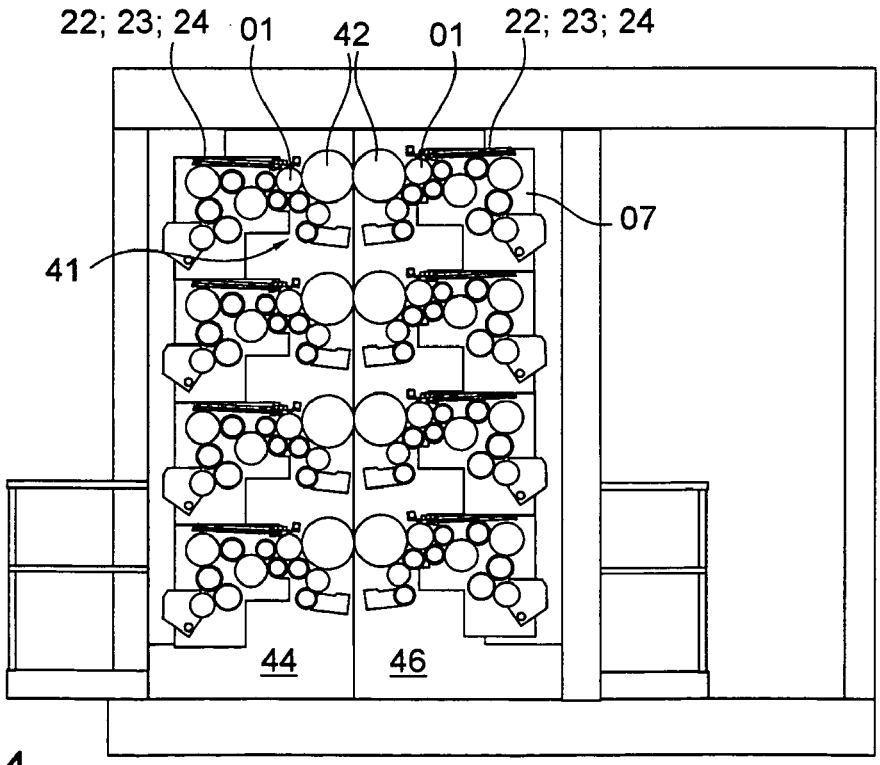

FIG. 21 to FIG. 24 are directed to arrangements of the devices each having the multiple storage compartments 22; 23; 24, and each being situated in a printing tower with printing couples arranged one above the other, such as, for example, in a compact structured eight-couple tower, which can be used in a double-sided, for example four-color, printing process. In FIG. 21 and in FIG. 22, the printing couple cylinders, i.e., the forme cylinders 01 and the respectively assigned transfer cylinders 42, are each double-sized in configuration. The devices with the plurality of storage compartments 22; 23; 24 are each preferably arranged generally horizontally and in a tangential alignment with each respective forme cylinder 01. The three storage compartments 22; 23; 24 each form an integrated unit that is corresponding to the representations in FIG. 1 through FIG. 17, for example. Each inking unit 07, which is engaged against its respective forme cylinder 01, is embodied as an anilox inking unit, for example. The printing unit has two halves 44; 46 which may be encompassed by a frame 47, for example, with at least one half 44 or 46 of the printing unit being mounted so as to be capable of moving toward or away from the other half 46; 44, respectively of the printing unit. FIG. 22 shows the printing unit of FIG. 21 with one printing unit half 44; 46 moved away from the other. The printing units which are represented in FIG. 23 and FIG. 24 differ from the printing units which are represented in FIGS. 21 and 22. The printing units depicted in FIG. 23 and in FIG. 24 show single-sized forme cylinders 01, which each cooperate with double-sized assigned transfer cylinders 42. In FIG. 23, the inking unit 07 that is engaged against each respective forme cylinder 01 is embodied, for example, as a short inking unit such as, for example, as an anilox inking unit. The respective inking unit 07 in the printing unit of FIG. 24 has a longer roller train. In the printing unit of FIG. 24 a dampening unit 41 is also engaged against each respective forme cylinder 01. In FIG. 23 and in FIG. 24, the devices with the plurality of storage compartments 22; 23; 24 are also each arranged either horizontally or at an inclination of up to 15°, and preferably of less than 10° from horizontal in relation to the respective forme cylinder 01, and are each positioned at a tangential alignment, in relation to the respective forme cylinder 01. The three storage compartments 22; 23; 24 again form an integrated unit corresponding to the representations in FIG. 1 through FIG. 17, for example. The printing units of FIGS. 23 and 24 can also have printing unit halves 44; 46 that can be separated by moving them apart.

While preferred embodiments of devices comprising a plurality of storage compartments arranged spaced from one another, in accordance with the present invention, have been set forth fully and completely hereinabove, it will be apparent to one of skill in the art that various changes in, for example, the specific drives for the cylinders, the structures of the frames of the printing units, the types of inks being applied to the webs and the like could be made without departing from the true spirit and scope of the subject invention which is accordingly to be limited only by the appended claims.

What is claimed is:

1. A plate storage device for use with a forme cylinder of a rotary printing press, said plate storage device comprising:

a plurality of storage compartments in said plate storage device and arranged spaced at a distance from one another, each one of said plurality of spaced storage compartments having at least one opening area facing the forme cylinder of the rotary each one of said plurality of spaced storage compartments being adapted to store at least one of a used printing forme removed from the forme cylinder of the rotary printing press and a new printing forme to be loaded on the forme cylinder of the rotary printing press;

at least one plate storage device positioning device, said at least one plate storage device positioning device being adapted to selectively adjust said at least one opening area of each one of at least two of said plurality of spaced storage compartments facing the forme cylinder, in each one of said opening area's operating state of engagement against the forme cylinder, into the same spatial position relative to the forme cylinder, at different points in time; and at least one printing forme conveyor device selectively engagable with at least two of said printing forrmes stored in at least one of said plurality of spaced storage compartments, said at least one plate storage device positioning device being usable to selectively adjust said spaced storage compartments relative to said at least one printing forme conveyor device.

2. The plate storage device of claim 1 wherein said plurality of storage compartments, which are to be adjusted at said different points in time to said same spatial position, are each provided with a stored printing forme to be loaded on said forme cylinder.

3. The plate storage device of claim 1 wherein one of said storage compartments has a used printing form a stored therein and another of said storage compartments has a new printing forme stored therein.

4. The plate storage device of claim 1 wherein said distance between said plurality of spaced storage compartments is constant.

5. The plate storage device of claim 1 wherein each of said plurality of spaced storage compartments can be adjusted, with respect to their spatial positions, between first and second stable operating positions at least with respect to their opening.

6. The plate storage device of claim 1 wherein said at least one positioning device is operable to alternatingly adjust said at least two storage compartment open areas to said same spatial position relative to said forme cylinder.

7. The plate storage device of claim 1 wherein said at least one positioning device pivots at least said opening areas of said at least two plate storage compartments about a rotational axis extending parallel to an axial direction of said forme cylinder and, with said pivotal movement, adjusts said spatial positioning of at least said opening areas of said storage compartments relative to said forme cylinder.

8. The plate storage device of claim 1 wherein said at least one positioning device causes the engagement of said opening areas of said at least two storage compartments, which face said forme cylinder tangentially, against said forme cylinder.

9. The plate storage device of claim 1 wherein said at least one positioning device adjusts said at least two storage compartments as a combined unit at different times to the same spatial position relative to said forme cylinder.

10. The plate storage device of claim 1 further including a a carrier in said conveyor device, said carrier being usable to convey said used printing forme, which is to be removed, from an operating position close to said forme cylinder to a storage position remote from said forme cylinder by a movement of said conveyor device executed along a length of said storage compartment to which said conveyor device is assigned.

11. The plate storage device of claim 10 wherein said carrier of said conveyor device is adapted to engage an angled suspension leg at a trailing end of said used printing forme to be removed from said forme cylinder.

12. The plate storage device of claim 10 further including an angled printing forme trailing end suspension leg on said used printing forme to be removed from said forme cylinder and engageable with said carrier of said at least one conveyor device.

13. The plate storage device of claim 12 wherein said trailing end suspension leg is releasable from said carrier by relative vertical movement between said carrier and said selected one of said plurality of storage compartments.

14. The plate storage device of claim 1 further including at least one new printing forme advancing mechanism in said conveyor device and adapted to convey a new printing forme from a selected of said plurality of spaced storage compartments to said forme cylinder, said at least one new printing fomre advancing mechanism including a slider element.

15. The plate storage device of claim 14 wherein said slider element of said advancing mechanism is adapted to engage an angled suspension leg at a trailing end of said new printing forme to be loaded on said forme cylinder.

16. The plate storage device of claim 14 wherein said new printing forme advancing mechanism is positionable in at least one other of said plurality of spaced storage compartments.

17. The plate storage device of claim 14 wherein said slider element is engageable with an angled printing forme trailing end suspension leg of said new printing forme to be conveyed to said forme cylinder.

18. The plate storage device of claim 17 wherein said slider element is engageable with said angled printing forme trailing end suspension leg in response to a variance of a vertical position of said carrier and said selected one of said plurality of spaced storage compartments.

19. The plate storage device of claim 1 wherein each said storage compartment opening area extends along a boundary of each said storage compartment facing said forme cylinder and extending in an axial direction of said forme cylinder.

20. The plate storage device of claim 19 wherein each said storage compartment boundary is parallel to a width of a printing forme received in each said storage compartment, said width extending parallel to said forme cylinder axial direction.

21. The plate storage device of claim 1 wherein said opening area of each said storage compartment is adjusted by said at least one plate storage positioning device to one of an infeed plane for said used printing forme to be received from said forme cylinder and an infeed plane for said new printing forme to be loaded on said cylinder.

22. The plate storage device of claim 21 wherein each said infeed plane is tangential to a circumferential surface of said forme cylinder and extends at least between said opening area and said forme cylinder circumferential surface.

23. The plate storage device of claim 21 wherein a transport path of each said printing forme to be one of loaded and removed extends along said infeed plane.

24. The plate storage device of claim 23 wherein said transport path is a straight line.

25. The plate storage device of claim 1 wherein said at least one positioning device is a lifting device.

26. The plate storage device of claim 1 wherein said at least one positioning device has an adjustment path range of between 5 mm and 30 mm.

27. The plate storage device of claim 1 wherein said at least one positioning device has an adjustment path which is perpendicular to said plurality of spaced storage compartments.

28. The plate storage device of claim 1 further including at least one support surface in at least one of said plurality of spaced storage compartments and adapted to support said printing forme stored in said at least one of said plurality of spaced storage compartments.

29. The plate storage device of claim 28 wherein said support surface engages first and second spaced printing forme edges extending generally perpendicular to said forme cylinder.

30. The plate storage device of claim 28 wherein a printing forme which is supported by said support surface and an infeed plane of said printing forme stored in said storage compartment have a constant path at least in a transition area of said printing forme to be conveyed to and from said forme cylinder.

31. The plate storage device of claim 28 wherein said support surface is embodied by at least one printing forme holding device adapted to hold said printing forme to be stored.

32. The plate storage device of claim 28 wherein said support surface includes at least one guide rail that extends along a length of a respective one of said printing formes to be stored.

33. The plate storage device of claim 28 wherein said support surface includes at least first and second guide rails arranged in a pair.

34. The plate storage device of claim 33 wherein said pair of guide rails each extend laterally of said printing forme to be stored.

35. The plate storage device of claim 28 wherein at least two of said plurality of storage compartments each include one of said support surfaces.

36. The plate storage device of claim 35 wherein said at least one positioning device displaces said support surfaces of said at least two of said plurality of storage compartments relative to each other.

37. The plate storage device of claim 36 wherein said support surfaces are displaced parallel to each other.

38. The plate storage device of claim 28 wherein each said support surface is permanently connected to its respective one of said plurality of storage compartments.

39. The plate storage device of claim 28 further including a cross member extending axially parallel to said forme cylinder and wherein each said support surface in at least one of said storage compartments is connected to said cross member.

40. The plate storage device of claim 39 wherein said support surfaces in all of said storage compartments are each connected to said cross member.

41. The plate storage device of claim 40 wherein said support surfaces are rigidly connected to said cross member.

42. The plate storage device of claim 40 wherein said support surfaces are separably connected to said cross member.

43. The plate storage device of claim 39 wherein said at least one positioning device contacts said cross member.

44. The plate storage device of claim 39 wherein said at least one positioning device selectively raises and lowers said cross member.

45. The plate storage device of claim 1 wherein said plurality of storage compartments are arranged as an integrated unit.

46. The plate storage device of claim 1 wherein said plurality of storage compartments are arranged in a shared housing.

47. The plate storage device of claim 1 wherein said plate storage device is engageable horizontally against said forme cylinder.

48. The plate storage device of claim 1 wherein said plate storage device is engageable against said forme cylinder at an angle of inclination of up to 15 degrees from horizontal.

49. The plate storage device of claim 1 wherein said plate storage device is engageable against said forme cylinder at an angle of inclination of between 15 degrees and 75 degrees from horizontal.

50. The plate storage device of claim 1 wherein said plate storage device is engageable inverted against said forme cylinder.

51. The plate storage device of claim 1 wherein ones of said plurality of storage compartments are arranged side-by-side in an axial direction of said forme cylinder.

52. The plate storage device of claim 51 wherein at least one of said plurality of storage compartments arranged side-by-side is adapted to store a double-width printing forme.

53. The plate storage device of claim 51 wherein there are six said storage compartments arranged side-by-side in said axial direction of said forme cylinder.

54. The plate storage device of claim 1 wherein at least one of said printing formes is a panoramic printing forme.

55. The plate storage device of claim 1 wherein said plate storage device is engageable against a single-sized forme cylinder.

56. The plate storage device of claim 1 wherein said plate storage device is engageable against a double-sized form cylinder.

57. The plate storage device of claim 1 wherein the rotary printing press includes a printing unit which has a single-sized forme cylinder and a double-sized cylinder cooperating with said single-sized forme cylinder.

58. The plate storage device of claim 1 wherein said plate storage device is arranged in a nine-couple satellite printing unit.

59. The plate storage device of claim 1 wherein said plate storage device is arranged in an eight-couple printing tower.

60. The plate storage device of claim 1 further including a plurality of said plate storage devices in a printing unit of the rotary printing press.

61. A plate storage device for use with a forme cylinder of a rotary printing press, said plate storage device comprising:

a plurality of storage compartments in said plate storage device and arranged spaced at a distance from one another, each one of said plurality of spaced storage compartments having at least one opening area facing the forme cylinder of the rotary printing press, each one of said plurality of spaced storage compartments being adapted to store at least one of a used printing forme removed from the forme cylinder of the rotary printing press and a new printing forme to be loaded on the forme cylinder of the rotary printing press;

at least one plate storage device positioning device, said at least one plate storage device positioning device being adapted to selectively adjust said at least one opening area of each one of at least two of said plurality of spaced storage compartments facing the forme cylinder, in each one of said opening area's operating state of engagement against the forme cylinder, into the same spatial position relative to the forme cylinder, at different points in time;

at least one printing forme conveyor device including at least one carrier that is engageable with a seleded printing forme to be removed in one of said plurality of spaced storage compartments and further including at least one new printing forme advancing mechanism that is engageable with a selected printing forme to be loaded on the forme cylinder from one of said plurality of spaced storage compartments, said at least one new printing forme advancing mechanism including a slider element, said at least one plate storage device positioning device being operable to raise and to lower said plurality of storage compartments, as a unit, relative to said carrier and said slider of said at least one printing forme conveyor device.

* * * * *

UNITED STATES PATENT AND TRADEMARK OFFICE

CERTIFICATE OF CORRECTION

PATENT NO. : 7,934,452 B2
APPLICATION NO. : 12/448360
DATED : May 3, 2011
INVENTOR(S) : Bernd Klaus Faist It is certified that error appears in the above-identified patent and that said Letters Patent is hereby corrected as shown below:

Column 13, in claim 1, line 66, after “rotary”, insert --printing press--.

Column 14, in claim 3, line 27, after “printing”, delete “form a” and insert --forme--.

Column 15, in claim 14, line 15, after “selected”, insert --one--; and
line 17, before “advancing”, change “fomre” to --forme--.

Signed and Sealed this
Twenty-sixth Day of July, 2011

David J. Kappos

David J. Kappos
*Director of the United States Patent and Trademark Office*